US012023559B2

(12) United States Patent
Taylor

(10) Patent No.: US 12,023,559 B2
(45) Date of Patent: Jul. 2, 2024

(54) PROPELLENT-DRIVEN GOLF CLUB TO LAUNCH A BALL WITHOUT REQUIRING A SWINGING ACTION ON THE PROPELLENT-DRIVEN GOLF CLUB

(71) Applicant: Roy H. Taylor, Byhalia, MS (US)

(72) Inventor: Roy H. Taylor, Byhalia, MS (US)

( * ) Notice: Subject to any disclaimer, the term of this patent is extended or adjusted under 35 U.S.C. 154(b) by 0 days.

(21) Appl. No.: 18/494,633

(22) Filed: Oct. 25, 2023

(65) Prior Publication Data

US 2024/0058665 A1 Feb. 22, 2024

Related U.S. Application Data

(63) Continuation-in-part of application No. 17/803,544, filed on Aug. 18, 2022.

(51) Int. Cl.

| | |
|---|---|
| ***A63B 53/08*** | (2015.01) |
| ***A63B 53/14*** | (2015.01) |
| ***A63B 60/00*** | (2015.01) |
| ***A63B 71/06*** | (2006.01) |

(52) U.S. Cl.

CPC ..... *A63B 53/08* (2013.01); *A63B 53/14* (2013.01); *A63B 60/002* (2020.08); *A63B 2071/0694* (2013.01); *A63B 2209/00* (2013.01)

(58) Field of Classification Search

CPC ..... A63B 53/08; A63B 60/002; A63B 53/14

See application file for complete search history.

(56) References Cited

U.S. PATENT DOCUMENTS 3,259,387 A * 7/1966 Beigay ..... A63F 7/2472 473/282

5,522,594 A * 6/1996 Taylor ..... A63B 53/04 473/282

(Continued)

FOREIGN PATENT DOCUMENTS

WO 1997002871 A1 1/1997

WO 1998020944 A1 5/1998

OTHER PUBLICATIONS

Get Back in the Game, Stay in the Game or Get in the Game, retrieved from the internet, retrieved on Oct. 24, 2023; <URL: https://www.powergolfclub.com/buy/store/item/1-power2golf-club-current-special-just-995>.

(Continued)

*Primary Examiner* — Eugene L Kim

*Assistant Examiner* — Christopher Glenn

(57) ABSTRACT

Disclosed herein is a propellent-driven golf club to launch a ball without requiring a swinging action on the propellent-driven golf club. Accordingly, the propellent-driven golf club may include a hollow shaft and a handle attached to the hollow shaft. Further, the propellent-driven golf club may include a golf club head assembly attached to the hollow shaft. Further, the golf club head assembly may include a rotary magazine configured to receive a reloadable wafer, the firing mechanism operationally coupled to the triggering device, a firing cylinder port configured to mate with at least a portion of the cartridge, a vortex generator, a range control mechanism comprising a range control valve fluidly coupled to an egress port of the chamber, a firing cylinder bore fluidly coupled to an outlet of the range control valve, and a piston movably disposed in the firing cylinder bore.

20 Claims, 29 Drawing Sheets

(56) References Cited

U.S. PATENT DOCUMENTS

| | | | | | |
|---|---|---|---|---|---|
| 5,816,927 | A * | 10/1998 | Taylor | A63B 60/00 | 473/282 |
| 5,860,869 | A * | 1/1999 | Duncalf | A63B 53/04 | 473/282 |
| 5,924,932 | A * | 7/1999 | Taylor | A63B 60/00 | 473/282 |
| 6,139,440 | A * | 10/2000 | Taylor | A63B 53/04 | 473/282 |
| 6,183,372 | B1 * | 2/2001 | Anderegg, Jr. | A63B 69/3685 | 473/131 |
| 8,579,721 | B1 * | 11/2013 | Taylor | A63B 65/122 | 473/282 |
| 10,065,082 | B2 | 9/2018 | James et al. | | |
| 2004/0127301 | A1 * | 7/2004 | Lee | A63B 53/0466 | 473/282 |
| 2013/0252753 | A1 * | 9/2013 | Taylor | A63B 65/122 | 473/282 |

OTHER PUBLICATIONS

The Swingless Golf Club (200+ yards Easy), retrieved from the internet, retrieved on Oct. 24, 2023; <URL: https://www.youtube.com/watch?v=ID3SzQzQKlw>.

* cited by examiner

PROPELLENT-DRIVEN GOLF CLUB TO LAUNCH A BALL WITHOUT REQUIRING A SWINGING ACTION ON THE PROPELLENT-DRIVEN GOLF CLUB

The current application is a continuation-in-part (CIP) application of the U.S. non-provisional application Ser. No. 17/803,544 filed on Aug. 18, 2022.

FIELD OF THE INVENTION

Generally, the present disclosure relates to the field of golf clubs. More specifically, the present disclosure relates to a propellent-driven golf club to launch a ball without requiring a swinging action on the propellent-driven golf club.

BACKGROUND OF THE INVENTION

The field of golf clubs is technologically important to several industries, business organizations, and/or individuals.

The recreational sport played on a golf course utilizes many types of golf clubs with varying face angles. Generally, golf clubs are swung in an arc starting above the user's head. This creates a club face velocity that imparts kinetic energy to the ball positioned on the ground or a tee. A shorter arc traveled by the club results in the transfer of less kinetic energy thereby varying the distance the ball travels. A key element of playing the game requires' controlling the precise direction and distance the ball travels along the course of play. Many users find playing the game of golf extremely challenging or unable to participate.

Current golf clubs add additional energy imparted to the ball by the release of energy stored in a mechanical compressed spring. Driving the ball occurs by swinging the club head in a downward arc contacting the ball thereby triggering the energy release. The practical success of this concept was limited since most of the difficulty occurred by a swing error due to a heavier club and user proficiency. Additionally, the ball compression energy release, the club head mechanical spring energy release, and the club head velocity kinetic energy release will not result in the sum of the three sources and thereby, not provide any improvement.

Further, current clubs use an explosive charge to add additional energy to the club head velocity created by the user swinging the club. The club design apparatus being heavier is likely to cause an errant swing to fail to trigger the device. Improved performance in driving the ball would be poor because the compressed energy in the ball would not occur at the precise instant the explosive charge occurred.

Furthermore, current golf clubs employ an explosive charge designed to add kinetic energy to a golf ball when detonated by a swinging motion of a club face. Swinging a club with the added weight and hitting a sweet spot detonator to add explosive energy to a ball being compressed with kinetic energy is extremely difficult. The stored energy sources will not release simultaneously, thereby failing to solve the problem. Current golf clubs require the user to swing a club, which is difficult even under conventional circumstances by a proficient user. Therefore, the very problem the patents attempt to address and improve is defeated by the very means utilized.

Further, a tremendous force caused the striker plate to return spring to deform and said piston and striker plate to detach from the rod as a result of mechanical failure. The high-pressure gas failed to burn completely leaving a residue that caused said piston to jam after a few cycles. The bushing-bearing containing petroleum lubrication changes into a sticky residue as a result of a chemical reaction when it is exposed to said high-pressure gas, which restricts the smooth travel of said piston, small diameter rod, and striker plate thereby causing failure. The hollow head made of aluminum failed to withstand the wear factor caused by the said piston travel. The cartridge holder being shaped with a flat surface failed to maintain an adequate seal thereby releasing high-pressure gas, thereby reducing the kinetic energy produced. Aside from the poor performance, current golf clubs do not provide means to adjust the ball travel distance.

Furthermore, current golf clubs failed to achieve a clean complete powder burn resulting in parts jamming, and said ball travel, failed as a result of most of the high-pressure gas being dissipated on the top of the piston before reaching the port designed to decrease the pressure and as a result failed to change the distance a ball would travel.

The high-pressure cartridges were contained in ducts around a wheel circumference and fired toward the center axis by a firing pin protruding through a hollow shaft into the head assembly thereby striking each cartridge in a revolving sequence. The fired cartridges discharged into the center of the wheel, thereby passing through an injection port in the cylinder. The cone-shaped center of the cartridge wheel fails to maintain an adequate seal, thereby allowing high-pressure gas to enter the adjacent cartridge ducts causing failure. The huge amount of volume between the top of the piston and the top of the cylinder created a premature drop in pressure thereby causing an incomplete powder burn which fouled the piston after a few cycles of operation.

The retractor means the design attempt failed to retract the piston because the pressure-volume required for the retracting action did not exist. The attempted buffer spring failed to be reliable. The assembled structure proved to be impractical, costly, and difficult to manufacture. Also, the head assembly and associated parts failed to withstand the dynamic operating pressure involved, namely the retraction concept; the tilt safety proved to be costly, impractical, and had no practical use.

Further, current golf clubs incorporating a clean burning vortex generator designed to reduce the unburned powder residue causes friction on moving parts resulting in reduced performance. The powder residue produced in gun powder as a result of its chemical structure, which may only be reduced not eliminated.

Furthermore, current golf clubs feature a golf club head with an attached handle assembly, designed to impart kinetic energy on to a golf ball without swinging the club. The kinetic energy is developed by burning a case-less propellant, that generates a high-pressure gas, which is adjustable in a linear fashion thereby, driving a golf ball along a course of play from a short distance, up to the distance of that of conventional clubs.

Therefore, there is a need for improved golf clubs that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a propellent-driven golf club to launch a ball without requiring a swinging action on the propellent-driven golf club, in accordance with some embodiments. Accordingly, the propellent-driven golf club may include a hollow shaft. Further, the propellent-driven golf club may include a handle attached to a top portion of the hollow shaft. Further, the handle may include a triggering device configured for actuating a firing mechanism. Further, the propellent-driven golf club may include a golf club head assembly attached to a bottom portion of the hollow shaft. Further, the golf club head assembly may include a rotary magazine configured to receive at least one reloadable wafer. Further, the rotary magazine may be rotatable about a hinge pivot. Further, the at least one reloadable wafer may include a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to mate with at least a portion of the cartridge. Further, the golf club head assembly may include a vortex generator that may include a chamber. Further, the chamber may include an ingress port and an egress port. Further, the ingress port may be fluidly coupled to the firing cylinder port in order to receive the gases. Further, an interior profile of the chamber may be deflected to force the gas to meet from opposite directions. Further, the golf club head assembly may include a range control mechanism that may include a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball.

In further embodiments, disclosed herein is a propellent-driven golf club to launch a ball without requiring a swinging action on the propellent-driven golf club. Accordingly, the propellent-driven golf club may include a hollow shaft. Further, the propellent-driven golf club may include a handle attached to a top portion of the hollow shaft. Further, the handle may include a triggering device configured for actuating a firing mechanism. Further, the propellent-driven golf club may include a golf club head assembly attached to a bottom portion of the hollow shaft. Further, the golf club head assembly may include a rotary magazine configured to receive at least one reloadable wafer. Further, the rotary magazine may be rotatable about a hinge pivot. Further, the at least one reloadable wafer may include a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to mate with at least a portion of the cartridge. Further, the golf club head assembly may include a vortex generator that may include a chamber. Further, the chamber may include an ingress port and an egress port. Further, the ingress port may be fluidly coupled to the firing cylinder port in order to receive the gases. Further, an interior profile of the chamber may be deflected to force the gas to meet from opposite directions. Further, the golf club head assembly may include a range control mechanism that may include a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball. Further, the golf club head assembly may include a rotary magazine housing configured to accommodate the rotary magazine. Further, the rotary magazine housing may be rotatable about the hinge pivot. Further, the rotary magazine housing may be configured for transitioning between an extended state and a retracted state. Further, the rotary magazine housing in the extended state facilitates reloading of the at least one reloadable wafer. Further, the rotary magazine housing in the retracted state facilitates orienting the cartridge in a firing position ready to be fired by the firing mechanism.

In further embodiments, disclosed herein is a propellent-driven golf club to launch a ball without requiring a swinging action on the propellent-driven golf club. Further, the propellent-driven golf club may include a hollow shaft. Further, the propellent-driven golf club may include a handle attached to a top portion of the hollow shaft. Further, the handle may include a triggering device configured for actuating a firing mechanism. Further, the handle may include a motorized handle mechanically coupled with the firing mechanism. Further, the motorized handle may include at least one motor switch that may include a top switch and a lower switch. Further, each of the top switch and the lower switch may be configured to be transitioned between a switch pressed state and a switch raised state. Further, the motorized handle may include an actuating motor configured for rotating a drive screw based on a state of the at least one switch. Further, the top switch in the switch depressed state causes clockwise rotation of the drive screw. Further, the lower switch in the switch depressed state causes counter-clockwise rotation of the drive screw. Further, the motorized handle may include a cocking actuator operationally coupled with the drive screw. Further, the cocking actuator may be configured to be transitioned between an actuator top position and an actuator bottom position based on the rotating of the drive screw. Further, the cocking actuator traverses from the actuator top position to the actuator bottom position based on the counter-clockwise rotation of the drive screw. Further, the cocking actuator traverses from the actuator bottom position to the actuator top position based on the clockwise rotation of the drive screw. Further, the motorized handle may include a rechargeable power source electrically coupled with the actuating motor. Further, the rechargeable power source may be configured for providing electrical power to the actuating motor. Further, a motorized firing pin spring comprised in the firing mechanism may be compressed based on the cocking actuator reaching the actuator top position. Further, the firing mechanism may be ready to fire the cartridge based on compressing of the motorized firing pin spring. Further, the propellent-driven golf club may include a golf club head assembly attached to a bottom portion of the hollow shaft. Further, the golf club head assembly may include a rotary magazine configured to receive at least one reloadable wafer. Further, the rotary magazine may be rotatable about a hinge pivot. Further, the at least one reloadable wafer may include a plurality of cartridges. Further, the golf club head assembly may include the firing mechanism operationally coupled to the triggering device. Further, the firing mechanism may be configured for firing a cartridge of the plurality of cartridges upon the actuating. Further, firing the cartridge generates gases. Further, the golf club head assembly may include a firing cylinder port configured to mate with at least a portion of the cartridge. Further, the golf club head assembly may include a vortex generator that may include a chamber. Further, the chamber may include an ingress port and an egress port. Further, the ingress port may be fluidly coupled to the firing cylinder port in order to receive the gases. Further, an interior profile of the chamber may be deflected to force the gas to meet from opposite directions. Further, the golf club head assembly may include a range control mechanism that may include a range control valve fluidly coupled to the egress port of the chamber. Further, the range control valve may be configured to control a pressure of the gases at an outlet of the range control valve. Further, the golf club head assembly may include a firing cylinder bore fluidly coupled to the outlet of the range control valve. Further, the golf club head assembly may include a piston movably disposed in the firing cylinder bore. Further, the gases drive the piston. Further, a free end of the piston may be configured to strike the ball. Further, the golf club head assembly may include a rotary magazine housing configured to accommodate the rotary magazine. Further, the rotary magazine housing may be rotatable about the hinge pivot. Further, the rotary magazine housing may be configured for transitioning between an extended state and a retracted state. Further, the rotary magazine housing in the extended state facilitates reloading of the at least one reloadable wafer. Further, the rotary magazine housing in the retracted state facilitates orienting the cartridge in a firing position ready to be fired by the firing mechanism.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. All rights to various trademarks and copyrights represented herein are vested in and the property of the Applicant. The Applicant retains and reserves all rights to the trademarks and copyrights included herein and has been assigned to grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
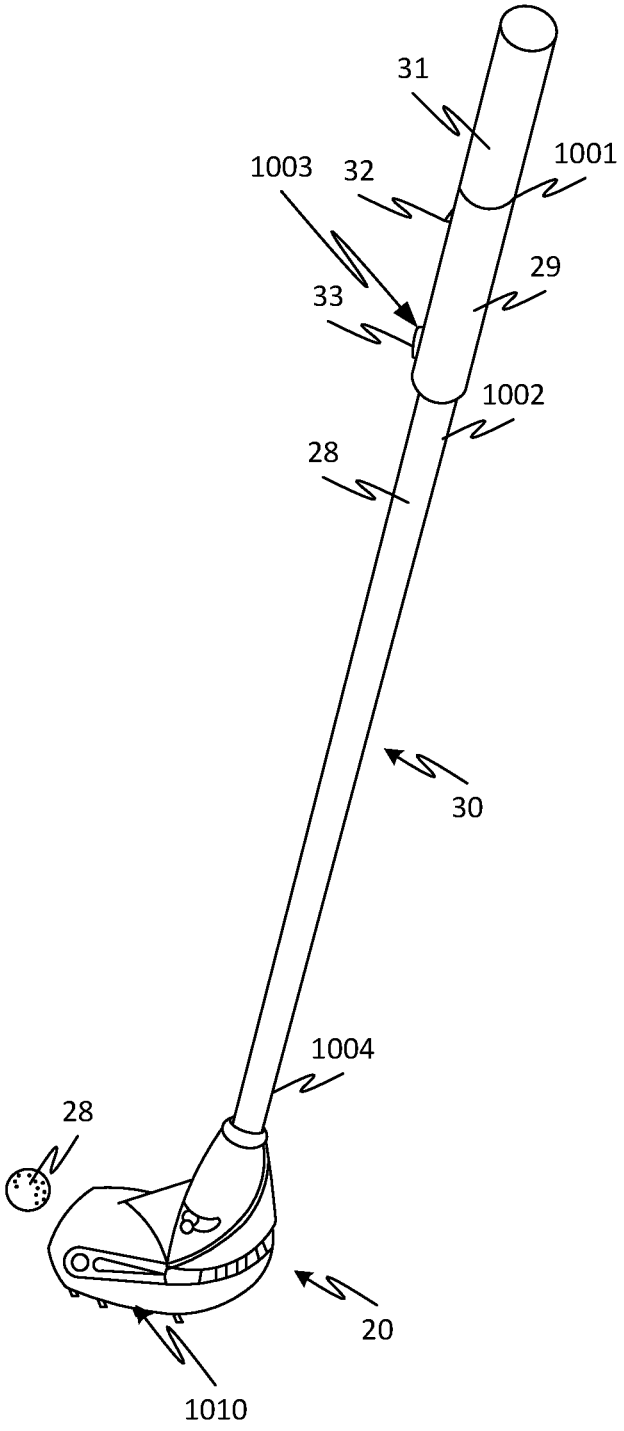
FIG. 1 is a schematic of a propellent-driven golf club 30 to launch a ball 139 without requiring a swinging action on the propellent-driven golf club 30, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one" but do not exclude a plurality unless the contextual use dictates otherwise. When used herein to join a list of items, "or" denotes "at least one of the items" but does not exclude a plurality of items of the list. Finally, when used herein to join a list of items, "and" denotes "all of the items of the list".

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a propellent-driven golf club to launch a ball without requiring a swinging action on the propellent-driven golf club, embodiments of the present disclosure are not limited to use only in this context.

Overview:

The present disclosure describes a propellent-driven golf club to launch a ball without requiring a swinging action on the propellent-driven golf club. Further, the disclosed golf club comprises a motorized firing pin cocking handle for a propellant-driven golf club, containing a rotary multi-cartridge magazine, attached to a golf club head assembly designed to propel a golf ball from a static position, without swinging the club. The motorized handle may include a triggering device, which releases the spring-loaded firing pin after being enabled by a safety release button to fire the golf club. When the golf club trigger is actuated the firing pin strikes one of a series of gun powder-filled cartridges positioned or selected by the operator, thereby firing the cartridge, driving a golf ball down the golf course of play.

The golf club comprises a die castable embodiment containing a cylinder mounted inside a hollow area of the golf club embodiment, where the hollow area creates a silencing chamber. Further, the golf club may include a firing port positioned at one end of the cylinder and directly over the vortex generator armature inlet ports housed in the closed end of the cylinder. The distance a golf ball will travel is accomplished by means of the vortex-generating armature, which directionally disperses the high-pressure gas. The vortex-generating armature core contains a series of specially designed orifices, which allow high-pressure gas to flow in the exact proportion toward the piston end of the striker/piston or into the silencing hollow area of the embodiment. The distance a ball will travel is determined by the distance setting, thereby controlling the amount of kinetic energy applied to the golf ball. Further, the disclosed golf club eliminates a piston, rod, bearing, and strike plate assembly, which are prone to failure. They are replaced with a slotted especially hardened Teflon impregnated or ceramic-coated, one-piece, striker/piston, which is moveable, riding on raised lands and grooves inside the diameter of the cylinder. The cylinder walls function as a bearing surface thereby, eliminating a conventional bearing and requiring less lubrication. The golf club provides for only Ballistol lubricate to be used to prevent failure.

Further, the slotted striker/piston provides for a urethane spring material extending through the slot, which seats against the slot limiting shaped cam, after the high-pressure gas discharge propelled the striker/piston through the travel cycle end, stopping against the through the urethane spring. The urethane spring absorbs the energy, acting as a striker/piston brake at the end of the cycle by displacing in a bending action and functions as a means to allow for quick removal for cleaning.

In accordance with another feature, the striker/piston face diameter is larger, thereby forming a DB reducer thruster ring, whereby escaping high-pressure gas "blow by" from the cylinder wall clearance gap, enters the rear extended diameter groove of the face thruster ring, which contain a series of small orifices designed to slow the high-speed gas flow rate before hitting the static atmosphere pressure, thereby reducing the DB level and adding more thrust to the striker/piston driving momentum.

Further, the golf club embodiment die-casting bore may include two "O" rings positioned at each end of the cylinder and are seated against the embodiment die-casting bore, which seals the silencing chamber. In accordance with some embodiments, the disclosed golf club may include a rotary cartridge magazine containing a series of gun powder cartridges allowing multiple cycles before reloading the magazine. Each selected cartridge is held firmly against a mating seal surface of the cylinder, by means of a firing pin cam rotor, mounted in the mating end of the handle assembly.

In an illustrative embodiment, the disclosed golf club may include an anti-skid cleat plate attached to the bottom of the club head in order to prevent recoil induced as each cartridge is fired. The club head recoil propels the club head in the opposite direction from the ball travel, thereby reducing the kinetic energy being applied to the ball, causing the ball to travel less distance.

In another illustrative embodiment, the disclosed golf club may include a range control lever designed to float independently on the range control valve shaft, thereby avoiding failure, which occurs in any fixed lever mounting method by the use of screws, prone to become loose, caused by the huge shock wave. The aft end of the cylinder is mounted in a tapered socket at the aft end of the disclosed golf club embodiment, held in place by two large screws projecting through the bottom of the embodiment (die casting) into the cylinder in a shear fashion and the forward end of the cylinder is held in position by a through stop pin or urethane spring material extending into embodiment bosses. The rotary magazine may be mounted on a swing "in and out" carrier for easy loading, whereby each cartridge requires only a short finger action by the operator to advance to the next cartridge.

Further, the golf club may be safe, operational, easy to use, and easy to manufacture by being designed to be die cast as opposed to an investment casting. Further, the golf club may include a rotary cartridge magazine containing a series of gun powder-filled cartridges, when fired develops high-pressure gas, which flows through a vortex generator disbursement, imperative to controlling the linear distance a golf ball travels. Further, the golf club may be capable of hitting golf balls multiple distances from a static position, without (swinging) the golf club. Further, the golf club may include a striker/piston made of solid one-piece construction containing a DB reducer thrust ring. Further, the striker/piston may not require a rod bearing and require little lubrication. Further, the golf club may include a urethane brake or access for a through flex urethane material bending action brake. Further, the golf club may include a special hard anodized Teflon-impregnated coating or a ceramic coating. Further, the golf club die casting may be made of aluminum, one piece construction. Further, the golf club may include a wafer containing a series of cartridges. Further, the golf club may include an easy to read, side mounted ball travel distance scale. Further, the golf club may include a motorized cocking handle. Further, the golf club may include an easy to assemble handle assembly. Further, the golf club may include a cylinder made of 17-4 stainless steel or other hard material. Further, the golf club may include a removable through stop pin or a bending action brake, which also allows easy cleaning and disassembly. Further, the golf club may include a unique golf club containing a recoil surface cleat.

The reference numerals in drawings are the following:

20 is the golf club embodiment head casting.
21 is the club head anti-skid cleat plate.
22 is the striker/piston face plate silencer.
23 is the striker piston stop pin.
24 is the medallion recess.
25 is the rotary cartridge magazine.
26 is the range distance scale.
27 is the club head embodiment casting housing.
28 is the golf club shaft.
29 is the lower trigger/safety handle.
30 is the golf club complete assembly.
31 is the upper cocking handle.
32 is the firing safety button.
33 is the firing trigger button.
34 is the firing pin housing cam lever.
35 is the golf club range control adjusting lever.
36 is the rotary magazine carrier faring.
37 is the rotary magazine housing.
38 is the handle frame bottom firing pin latching pawl housing.
39 is the handle frame bottom firing pin linkage rod housing.
40 is the handle frame assembly.
41 is the shaft mounting screw hole.
42 is the shaft mounting connector.
43 is the handle frame trigger latch housing.
44 is the handle frame body.
45 is the handle frame top firing pin linkage rod housing.
46 is the firing pin hammer.
47 is the shaft head coupling.
48 is the firing pin spring.
49 is the firing pin cocking rod.
50 is the handle assembly lower grip.
51 is the handle assembly upper grip.
52 is the safety slide return spring.
53 is the linkage rod cocking engagement clip.
54 is the linkage rod retainer ring.
55 is the cocking handle sleeve forward return spring retaining pin.
56 is the cocking handle sleeve return spring.
57 is the cocking handle sleeve aft return spring retaining pin.
58 is the linkage rod trigger latching pawl.
59 is the safety slide.
60 is the shaft head coupling faring.
61 is the firing pin housing cam stator mounting hole.
62 is the firing pin housing stator cam.
63 is the firing pin.
64 is the firing pin retainer notch.
65 is the firing pin return spring.
66 is the firing pin housing cam rotor.
67 is the firing pin housing cam lever mounting screw.
68 is the firing pin housing cam lever mounting hole.
69 is the right side cylinder embodiment mounting hole.
70 is the left side cylinder embodiment mounting hole.
71 is the rotary magazine numbers.
72 is the rotary magazine retainer clip housing.
73 is the rotary magazine bearing.
74 is the cartridge housing.
75 is the rotary magazine wafer proprietary key.
76 is the rotary magazine carrier clip groove.
77 is the rotary magazine carrier shaft.
78 is the rotary magazine carrier hinge pivot.
79 is the rotary magazine carrier.
80 is the range control valve shaft key.
81 is the range control valve mounting threads.
82 is the range control valve high pressure gas shield.
83, 84, 85, and 86 are the range control valve shaft vortex generator.
87 is the range control vent down chamber.

88 is the range control valve armature.
89 is the range control gas port.
90 is the range control valve.
91, 92, 93, 94, and 95 are the range control gas port.
96 is the striker piston land.
97 is the striker piston groove.
98 is the striker piston urethane housing.
99 is the piston end of striker piston.
100 is the striker piston.
101 is the stop pin slot.
102 is the gas reversal thruster silencer.
103 is the gas reversal thruster silencer port.
104 is the striker piston ball traction grooves.
105 is the cylinder striker face housing.
106 is the cylinder bore.
107 is the cylinder final vent down port.
108 and 109 are the cylinder primary vent down port.
110 is the range control valve surface.
111 is the vortex generator chamber.
112 is the range control shaft "O" ring groove.
113 is the cylinder range control shaft hole.
114 is the cylinder aft "O" ring groove.
115 is the cylinder range control port.
116 is the cylinder.
117 is the primary vent down port.
118 is the cylinder final vent down port.
119 is the stop pin hole.
120 is the forward "O" ring groove.
121 is the cylinder port seal.
122 is the cylinder port.
123 is the range control lever bushing groove.
124 is the range control lever key.
125 is the range control valve lock nut.
126 is the range control valve nut.
127 is the trust washer.
128 is the range control lever key.
129 is the range control key washer.
130 is the range control lever bushing.
131 is an embodiment of the stop pin hole.
132 is an embodiment of the stop pin hole.
133 is an embodiment of the expansion chamber.
134 is the cylinder mounting.
135 is the range control shaft housing.
136 is the range control mounting nuts housing.
137 is the stop spring snubber.
138 is the stop pin.
139 is the golf ball.
140 is the cartridge wafer.
141 is the rotary index spring ball.
142 is the cartridge wafer index detents.
143 is the cartridge.
144 is the motorized handle motor switch.
145 is the motorized handle motor.
146 is the motorized handle drive clutch shaft.
147 is the motorized handle drive screw.
148 is the motorized handle clutch pressure spring.
149 is the motorized handle adaptor mounting housing.
150 is the motorized handle cocking actuator.
151 is the motorized handle trigger and safety slide housing.
152 is the motorized handle safety slide return spring.
153 is the motorized handle safety slide button.
154 is the motorized handle trigger hinge pin.
155 is the motorized handle trigger and button.
156 is the motorized trigger return spring.
157 is the motorized handle firing pin linkage rod.
158 is the motorized handle housing.
159 is the motorized handle cocking release spring.
160 is the motorized handle cocking engagement spring.
161 is the motorized handle cocking engagement spring release rod.
162 is the motorized handle drive screw clutch.
163 is the motorized handle pressure power clutch.
164 is the motorized handle cocking latching pawl.
165 is the motorized handle main firing pin spring.
166 is the motorized handle main firing pin spring retainer.
167 is the motorized handle.
168 is the motorized motor drive spindle.

The present disclosure describes a means for driving a golf ball utilizing a ballistic impeller golf club, which uses a series of blank gun powder cartridges, contained in a removable and replaceable cartridge wafer. The cartridge wafer in the rotary magazine solves the reloading hardship in past inventions and doubles the loading capacity. The disclosed golf club includes a gas reversal thruster to increase ball travel distance and reduce the DB level output by venting high-pressure gas flowing through a series of sound-absorbing ports. The disclosed golf club includes a firing pin housing cam assembly as part of the manually cocking version handle, thereby lowering the cost to manufacture, improving operation and assembly eliminating complications, where major parts are designed to be die cast, thereby lowering the manufacturing cost. The invention includes a battery-driven motorized firing pin cocking system for easy user-friendly operation. The person reviewing this invention will clearly see and understand the importance of an invention to function and perform flawlessly in the marketplace. The scope of the disclosed golf club may be double loading capacity and provide a super residue burner vortex generator, among other ramifications.

The golf club reduces the cost of manufacture and provides higher reliability by implementing a 17-4 stainless steel or other stronger material cylinder, combined with a hard-coated Teflon or ceramic material one-piece striker piston and urethane spring bending action to solve the lubrication problem by the use of Ballistol lubrication as means to eliminate structural failure. The disclosed golf club contains a silencing chamber to reduce the DB sound level output, including an added DB reducer thruster ring added to the striker piston. Other variations are possible, such as golf clubs that are multi-colored, and manufactured for people that are left-handed of smaller stature.

Further, the golf club may be capable of driving a golf ball varying distances from a static position without swinging the club, comprising an embodiment, a firing cylinder, a rotary magazine containing a series of gun powder cartridges, in a reloadable wafer, a valve arrangement for controlling the flow of high-pressure gas from a cylinder, located within a golf club embodiment, to propel a striker/piston outward to drive a golf ball, variable distances. Further, the golf club may include a cylinder containing a super burner vortex generator, that extends through the central axis of an embodiment and forms a silencing chamber.

Further, disclosed herein is a method of operating the apparatus with a triggering device for firing selected gun powder cartages developing high-pressure gas controlled by an adjustable setting.

Figure 7:
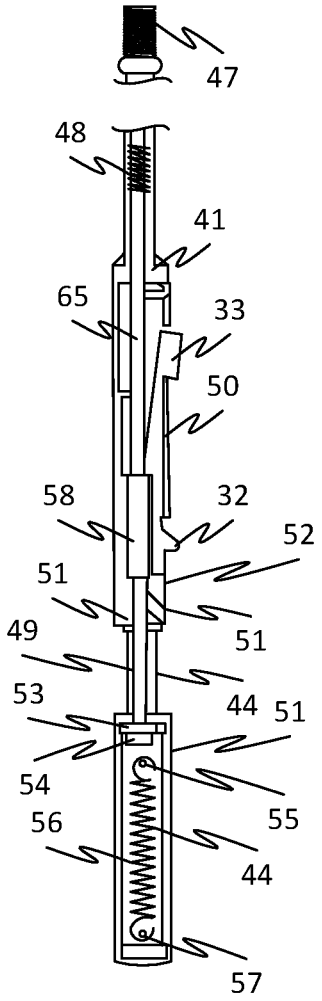
FIG. 7 is a cutaway view of the handle 1001, in accordance with some embodiments.

FIG. 1 is a schematic of a propellent-driven golf club 30 to launch a ball 139 without requiring a swinging action on the propellent-driven golf club 30, in accordance with some embodiments. Accordingly, the propellent-driven golf club 30 may include a hollow shaft 28. Further, the propellent-driven golf club 30 may include a handle 1001 attached to a top portion 1002 of the hollow shaft 28. Further, the handle 1001 may include a triggering device 1003 configured for actuating a firing mechanism 1004 (as shown in FIG. 7). Further, the propellent-driven golf club 30 may include a golf club head assembly 20 attached to a bottom portion 1004 of the hollow shaft 28. Further, the golf club head assembly 20 may include a rotary magazine 25 configured to receive at least one reloadable wafer 140. Further, the rotary magazine 25 may be rotatable about a hinge pivot 78. Further, the at least one reloadable wafer 140 may include a plurality of cartridges 143 and 1403. Further, the golf club head assembly 20 may include the firing mechanism 1004 operationally coupled to the triggering device 1003. Further, the firing mechanism 1004 may be configured for firing a cartridge of the plurality of cartridges 143 and 1403 upon the actuating. Further, firing the cartridge generates gases. Further, the golf club head assembly 20 may include a firing cylinder port 122 configured to mate with at least a portion of the cartridge. Further, the golf club head assembly 20 may include a vortex generator 111 that may include a chamber 1005. Further, the chamber 1005 may include an ingress port 1006 and an egress port 1007. Further, the ingress port 1006 may be fluidly coupled to the firing cylinder port 122 in order to receive the gases. Further, an interior profile of the chamber 1005 may be deflected to force the gas to meet from opposite directions. Further, the golf club head assembly 20 may include a range control mechanism 1008 that may include a range control valve 90 fluidly coupled to the egress port 1007 of the chamber 1005. Further, the range control valve 90 may be configured to control a pressure of the gases at an outlet of the range control valve 90. Further, the golf club head assembly 20 may include a firing cylinder bore 106 fluidly coupled to the outlet of the range control valve 90. Further, the golf club head assembly 20 may include a piston 100 movably disposed in the firing cylinder bore 106. Further, the gases drive the piston 100. Further, a free end of the piston 100 may be configured to strike the ball 139.

Further, in some embodiments, the golf club head assembly 20 may include a urethane spring brake 137 extending horizontally in a longitudinal slot comprised in the firing cylinder bore 106. Further, the piston 100 stops against the urethane spring brake 137 after launching the ball 139. Further, the urethane spring brake 137 may be configured for absorbing a kinetic energy of the piston 100 for stopping the piston 100. Further, the urethane spring brake 137 deforms based on the piston 100 stopping against the urethane spring brake 137.

In further embodiments, the propellent-driven golf club 30 may include Ballistol lubricant applied on at least one of the piston 100 and the firing cylinder bore 106 for reducing friction between the piston 100 and the firing cylinder bore 106. Further, the reducing of the friction between the piston 100 and the firing cylinder bore 106 facilitates driving of the piston 100.

Further, in some embodiments, the handle 1001 may include a motorized handle 167 mechanically coupled with the firing mechanism 1004. Further, the motorized handle 167 may include at least one motor switch 144 that may include a top switch 1402 and a lower switch 1404. Further, each of the top switch 1402 and the lower switch 1404 may be configured to be transitioned between a switch pressed state and a switch raised state. Further, the motorized handle 167 may include an actuating motor 145 configured for rotating a drive screw 147 based on a state of the at least one switch. Further, the top switch 1402 in the switch depressed state causes clockwise rotation of the drive screw 147. Further, the lower switch 1404 in the switch depressed state causes counter-clockwise rotation of the drive screw 147. Further, the actuating motor 145 may be operationally coupled with the top switch 1402 and the lower switch 1404. Further, the motorized handle 167 may include a cocking actuator 150 operationally coupled with the drive screw 147. Further, the cocking actuator 150 may be configured to be transitioned between an actuator top position and an actuator bottom position based on the rotating of the drive screw 147. Further, the cocking actuator 150 traverses from the actuator top position to the actuator bottom position based on the counter-clockwise rotation of the drive screw 147. Further, the cocking actuator 150 traverses from the actuator bottom position to the actuator top position based on the clockwise rotation of the drive screw 147. Further, the motorized handle 167 may include a rechargeable power source 1406 electrically coupled with the actuating motor 145. Further, the rechargeable power source 1406 may be configured for providing electrical power to the actuating motor 145. Further, a motorized firing pin spring 165 comprised in the firing mechanism 1004 may be compressed based on the cocking actuator 150 reaching the actuator top position. Further, the firing mechanism 1004 may be ready to fire the cartridge based on compressing of the motorized firing pin spring 165.

Further, in some embodiments, the golf club head assembly 20 further may include a rotary magazine housing 37 configured to accommodate the rotary magazine 25. Further, the rotary magazine housing 37 may be rotatable about the hinge pivot 78. Further, the rotary magazine housing 37 may be configured for transitioning between an extended state and a retracted state. Further, the rotary magazine housing 37 in the extended state facilitates reloading of the at least one reloadable wafer 140. Further, the rotary magazine housing 37 in the retracted state facilitates orienting the cartridge in a firing position ready to be fired by the firing mechanism 1004.

Further, in some embodiments, the golf club head assembly 20 may include a firing pin housing lever 34 configured to be pressed forward for transitioning the firing pin housing lever 34 to an activated state from a deactivated state based on a user pressing action performed by a user to facilitate reloading of the propellent-driven golf club 30. Further, the reloading of the propellent-driven golf club 30 may include positioning a second cartridge of the plurality of cartridges 143 and 1403 to a firing position after firing of the cartridge. Further, the golf club head assembly 20 may include a firing pin housing cam rotor 66 operationally coupled with the firing pin housing lever 34. Further, the firing pin housing cam rotor 66 configured to be rotated based on a user rotating action. Further, the user rotating action positions the firing pin housing cam rotor 66 on top of the second cartridge to be fired. Further, the transitioning of the firing pin housing lever 34 to the activated state followed by the user rotating action positions the second cartridge to the firing position. Further, the firing mechanism 1004 may be configured for firing the second cartridge in the firing position.

Further, in some embodiments, the handle 1001 may include an upper cocking handle 31 mechanically coupled with the firing mechanism 1004. Further, the upper cocking handle 31 may be configured to be transitioned between a lifted state and a resting state using a cocking handle sleeve return spring 56. Further, the transitioning of the upper cocking handle 31 from the resting state to the lifted state may be based on a lifting action performed by a user. Further, the transitioning of the upper cocking handle 31 from the lifted state to the resting state may be based on the cocking handle sleeve return spring 56. Further, the transitioning of the upper cocking handle 31 from the lifted state to the resting state cocks a firing pin spring comprised in the firing mechanism 1004. Further, cocking of the firing pin spring corresponds to preparing the firing mechanism 1004 for firing the cartridge.

Further, in some embodiments, the range control mechanism 1008 further may include a range control lever 35 and a ball travel scale 26. Further, the range control lever 35 may be disposed proximal to the ball travel scale 26. Further, the ball travel scale 26 may include a visual representation for displaying a plurality of distances. Further, the range control lever 35 may be positionable at a plurality of positions relative to the ball travel scale 26. Further, the plurality of positions corresponds to the plurality of distances for propelling the ball 139.

Further, in some embodiments, the range control lever 35 may be configured to float independently on a range control valve shaft 83 to prevent loosening of the range control lever 35 on the range control valve shaft 83 due to shock waves generated during the firing of the cartridge. Further, the range control valve shaft 83 may be comprised in the range control mechanism 1008.

In further embodiments, the propellent-driven golf club 30 may include a reducer thruster ring 102 disposed around a periphery of the firing cylinder bore 106 proximal to a club face 22 of the propellent-driven golf club 30. Further, the reducer thruster ring 102 may include a plurality of orifices 103 configured for reducing a flow rate of the gases before hitting a static atmospheric pressure. Further, the reducing the flow rate of the gases reduces a sound decibel level associated with the firing of the cartridge.

Further, in some embodiments, the chamber 1005 may include a coating of platinum, rhodium, and *Caladium* on an internal surface of the chamber 1005.

Further, in some embodiments, the piston 100 may include a plurality of raised lands 96 and a plurality of grooves 97 disposed on an outer surface of the piston 100. Further, the piston 100 slides on the plurality of raised lands 96 and the plurality of grooves 97. Further, sliding of the piston 100 corresponds to driving of the piston 100.

In further embodiments, the propellent-driven golf club 30 may include a hard anodized Teflon coating impregnated on the piston 100. Further, the hard anodized Teflon coating reduces friction between the piston 100 and the firing cylinder bore 106 for facilitating the sliding of the piston 100.

Further, in some embodiments, the propellent-driven golf club 30 may include a ceramic coating on the piston 100, wherein the ceramic coating reduces friction between the piston 100 and the firing cylinder bore 106 for facilitating the sliding of the piston 100.

In further embodiments, the propellent-driven golf club 30 may include an anti-skid mechanism 1010 disposed on a bottom surface 1012 of the golf club head assembly 20. Further, the anti-skid mechanism 1010 may include a cleat plate 21. Further, the cleat plate 21 may include a plurality of cleats configured to generate a frictional force between the propellent-driven golf club 30 and an external ground surface. Further, the propellent-driven golf club 30 rests on the external ground surface during the propelling of the ball 139. Further, the frictional force resists a recoil motion imparted to the propellent-driven golf club 30 based on the firing of the cartridge.

Further, in some embodiments, the triggering device 1003 comprises a safety button 32 and a firing button 33, wherein the safety button 32 is operatively coupled with the firing button 33, wherein the safety button 32 is configured to be transitioned between a pulled state and a relaxed state, wherein the firing button 33 is configured to be transitioned between a depressed state and a raised state, wherein the actuating of the firing mechanism 1004 comprises transitioning the safety button 32 to the pulled state followed by transitioning of the firing button 33 to the depressed state.

In further embodiments, disclosed herein is the propellent-driven golf club 30 to launch the ball 139 without requiring a swinging action on the propellent-driven golf club 30. Accordingly, the propellent-driven golf club 30 may include the hollow shaft 28. Further, the propellent-driven golf club 30 may include the handle 1001 attached to the top portion 1002 of the hollow shaft 28. Further, the handle 1001 may include the triggering device 1003 configured for actuating the firing mechanism 1004. Further, the propellent-driven golf club 30 may include the golf club head assembly 20 attached to the bottom portion 1004 of the hollow shaft 28. Further, the golf club head assembly 20 may include the rotary magazine 25 configured to receive the at least one reloadable wafer 140. Further, the rotary magazine 25 may be rotatable about the hinge pivot 78. Further, the at least one reloadable wafer 140 may include the plurality of cartridges 143 and 1403. Further, the golf club head assembly 20 may include the firing mechanism 1004 operationally coupled to the triggering device 1003. Further, the firing mechanism 1004 may be configured for firing a cartridge of the plurality of cartridges 143 and 1403 upon the actuating. Further, firing the cartridge generates gases. Further, the golf club head assembly 20 may include the firing cylinder port 122 configured to mate with at least a portion of the cartridge. Further, the golf club head assembly 20 may include the vortex generator 111 that may include the chamber 1005. Further, the chamber 1005 may include the ingress port 1006 and the egress port 1007. Further, the ingress port 1006 may be fluidly coupled to the firing cylinder port 122 in order to receive the gases. Further, an interior profile of the chamber 1005 may be deflected to force the gas to meet from opposite directions. Further, the golf club head assembly 20 may include the range control mechanism 1008 that may include the range control valve 90 fluidly coupled to the egress port 1007 of the chamber 1005. Further, the range control valve 90 may be configured to control a pressure of the gases at an outlet of the range control valve 90. Further, the golf club head assembly 20 may include the firing cylinder bore 106 fluidly coupled to the outlet of the range control valve 90. Further, the golf club head assembly 20 may include the piston 100 movably disposed in the firing cylinder bore 106. Further, the gases drive the piston 100. Further, a free end of the piston 100 may be configured to strike the ball 139. Further, the golf club head assembly 20 may include the rotary magazine housing 37 configured to accommodate the rotary magazine 25. Further, the rotary magazine housing 37 may be rotatable about the hinge pivot 78. Further, the rotary magazine housing 37 may be configured for transitioning between an extended state and a retracted state. Further, the rotary magazine housing 37 in the extended state facilitates reloading of the at least one reloadable wafer 140. Further, the rotary magazine housing 37 in the retracted state facilitates orienting the cartridge in a firing position ready to be fired by the firing mechanism 1004.

Further, in some embodiments, the golf club head assembly 20 may include the urethane spring brake 137 extending horizontally in a longitudinal slot comprised in the firing cylinder bore 106. Further, the piston 100 stops against the urethane spring brake 137 after launching the ball 139.

Further, the urethane spring brake 137 may be configured for absorbing a kinetic energy of the piston 100 for stopping the piston 100. Further, the urethane spring brake 137 deforms based on the piston 100 stopping against the urethane spring brake 137.

Further, in some embodiments, the handle 1001 may include the motorized handle 167 mechanically coupled with the firing mechanism 1004. Further, the motorized handle 167 may include the at least one motor switch 144 that may include the top switch 1402 and the lower switch 1404. Further, each of the top switch 1402 and the lower switch 1404 may be configured to be transitioned between a switch pressed state and a switch raised state. Further, the motorized handle 167 may include the actuating motor 145 configured for rotating the drive screw 147 based on a state of the at least one switch. Further, the top switch 1402 in the switch depressed state causes clockwise rotation of the drive screw 147. Further, the lower switch 1404 in the switch depressed state causes counter-clockwise rotation of the drive screw 147. Further, the motorized handle 167 may include the cocking actuator 150 operationally coupled with the drive screw 147. Further, the cocking actuator 150 may be configured to be transitioned between an actuator top position and an actuator bottom position based on the rotating of the drive screw 147. Further, the cocking actuator 150 traverses from the actuator top position to the actuator bottom position based on the counter-clockwise rotation of the drive screw 147. Further, the cocking actuator 150 traverses from the actuator bottom position to the actuator top position based on the clockwise rotation of the drive screw 147. Further, the motorized handle 167 may include the rechargeable power source 1406 electrically coupled with the actuating motor 145. Further, the rechargeable power source 1406 may be configured for providing electrical power to the actuating motor 145. Further, the motorized firing pin spring 165 comprised in the firing mechanism 1004 may be compressed based on the cocking actuator 150 reaching the actuator top position. Further, the firing mechanism 1004 may be ready to fire the cartridge based on compressing of the motorized firing pin spring 165.

Further, in some embodiments, the golf club head assembly 20 may include the firing pin housing lever 34 configured to be pressed forward for transitioning the firing pin housing lever 34 to an activated state from a deactivated state based on a user pressing action performed by a user to facilitate reloading of the propellent-driven golf club 30. Further, the reloading of the propellent-driven golf club 30 may include positioning a second cartridge of the plurality of cartridges 143 and 1403 to a firing position after firing of the cartridge. Further, the golf club head assembly 20 further may include the firing pin housing cam rotor 66 operationally coupled with the firing pin housing lever 34. Further, the firing pin housing cam rotor 66 configured to be rotated based on a user rotating action. Further, the user rotating action positions the firing pin housing cam rotor 66 on top of the second cartridge to be fired. Further, the transitioning of the firing pin housing lever 34 to the activated state followed by the user rotating action positions the second cartridge to the firing position. Further, the firing mechanism 1004 may be configured for firing the second cartridge in the firing position.

Further, in some embodiments, the range control mechanism 1008 may further include the range control lever 35 and the ball travel scale 26. Further, the range control lever 35 may be disposed proximal to the ball travel scale 26. Further, the ball travel scale 26 may include a visual representation for displaying a plurality of distances. Further, the range control lever 35 may be positionable at a plurality of positions relative to the ball travel scale 26. Further, the plurality of positions corresponds to the plurality of distances for launching or propelling the ball 139.

In further embodiments, disclosed herein is the propellent-driven golf club 30 to launch the ball 139 without requiring a swinging action on the propellent-driven golf club 30. Further, the propellent-driven golf club 30 may include the hollow shaft 28. Further, the propellent-driven golf club 30 may include the handle 1001 attached to the top portion 1002 of the hollow shaft 28. Further, the handle 1001 may include the triggering device 1003 configured for actuating the firing mechanism 1004. Further, the handle 1001 may include the motorized handle 167 mechanically coupled with the firing mechanism 1004. Further, the motorized handle 167 may include the at least one motor switch 144 that may include the top switch 1402 and the lower switch 1404. Further, each of the top switch 1402 and the lower switch 1404 may be configured to be transitioned between a switch pressed state and a switch raised state. Further, the motorized handle 167 may include the actuating motor 145 configured for rotating the drive screw 147 based on a state of the at least one switch. Further, the top switch 1402 in the switch depressed state causes clockwise rotation of the drive screw 147. Further, the lower switch 1404 in the switch depressed state causes counter-clockwise rotation of the drive screw 147. Further, the motorized handle 167 may include the cocking actuator 150 operationally coupled with the drive screw 147. Further, the cocking actuator 150 may be configured to be transitioned between an actuator top position and an actuator bottom position based on the rotating of the drive screw 147. Further, the cocking actuator 150 traverses from the actuator top position to the actuator bottom position based on the counter-clockwise rotation of the drive screw 147. Further, the cocking actuator 150 traverses from the actuator bottom position to the actuator top position based on the clockwise rotation of the drive screw 147. Further, the motorized handle 167 may include the rechargeable power source 1406 electrically coupled with the actuating motor 145. Further, the rechargeable power source 1406 may be configured for providing electrical power to the actuating motor 145. Further, the motorized firing pin spring 165 comprised in the firing mechanism 1004 may be compressed based on the cocking actuator 150 reaching the actuator top position. Further, the firing mechanism 1004 may be ready to fire the cartridge based on compressing of the motorized firing pin spring 165.

Further, the propellent-driven golf club 30 may include the golf club head assembly 20 attached to the bottom portion 1004 of the hollow shaft 28. Further, the golf club head assembly 20 may include the rotary magazine 25 configured to receive the at least one reloadable wafer 140. Further, the rotary magazine 25 may be rotatable about the hinge pivot 78. Further, the at least one reloadable wafer 140 may include the plurality of cartridges 143 and 1403. Further, the golf club head assembly 20 may include the firing mechanism 1004 operationally coupled to the triggering device 1003. Further, the firing mechanism 1004 may be configured for firing a cartridge of the plurality of cartridges 143 and 1403 upon the actuating. Further, firing the cartridge generates gases. Further, the golf club head assembly 20 may include the firing cylinder port 122 configured to mate with at least a portion of the cartridge. Further, the golf club head assembly 20 may include the vortex generator 111 that may include the chamber 1005. Further, the chamber 1005 may include the ingress port 1006 and the egress port 1007. Further, the ingress port 1006 may be fluidly coupled to the firing cylinder port 122 in order to receive the gases. Further, an interior profile of the chamber 1005 may be deflected to force the gas to meet from opposite directions. Further, the golf club head assembly 20 may include the range control mechanism 1008 that may include the range control valve 90 fluidly coupled to the egress port 1007 of the chamber 1005. Further, the range control valve 90 may be configured to control a pressure of the gases at an outlet of the range control valve 90. Further, the golf club head assembly 20 may include the firing cylinder bore 106 fluidly coupled to the outlet of the range control valve 90. Further, the golf club head assembly 20 may include the piston 100 movably disposed in the firing cylinder bore 106. Further, the gases drive the piston 100. Further, a free end of the piston 100 may be configured to strike the ball 139. Further, the golf club head assembly 20 may include the rotary magazine housing 37 configured to accommodate the rotary magazine 25. Further, the rotary magazine housing 37 may be rotatable about the hinge pivot 78. Further, the rotary magazine housing 37 may be configured for transitioning between an extended state and a retracted state. Further, the rotary magazine housing 37 in the extended state facilitates reloading of the at least one reloadable wafer 140. Further, the rotary magazine housing 37 in the retracted state facilitates orienting the cartridge in a firing position ready to be fired by the firing mechanism 1004.

Figure 2:
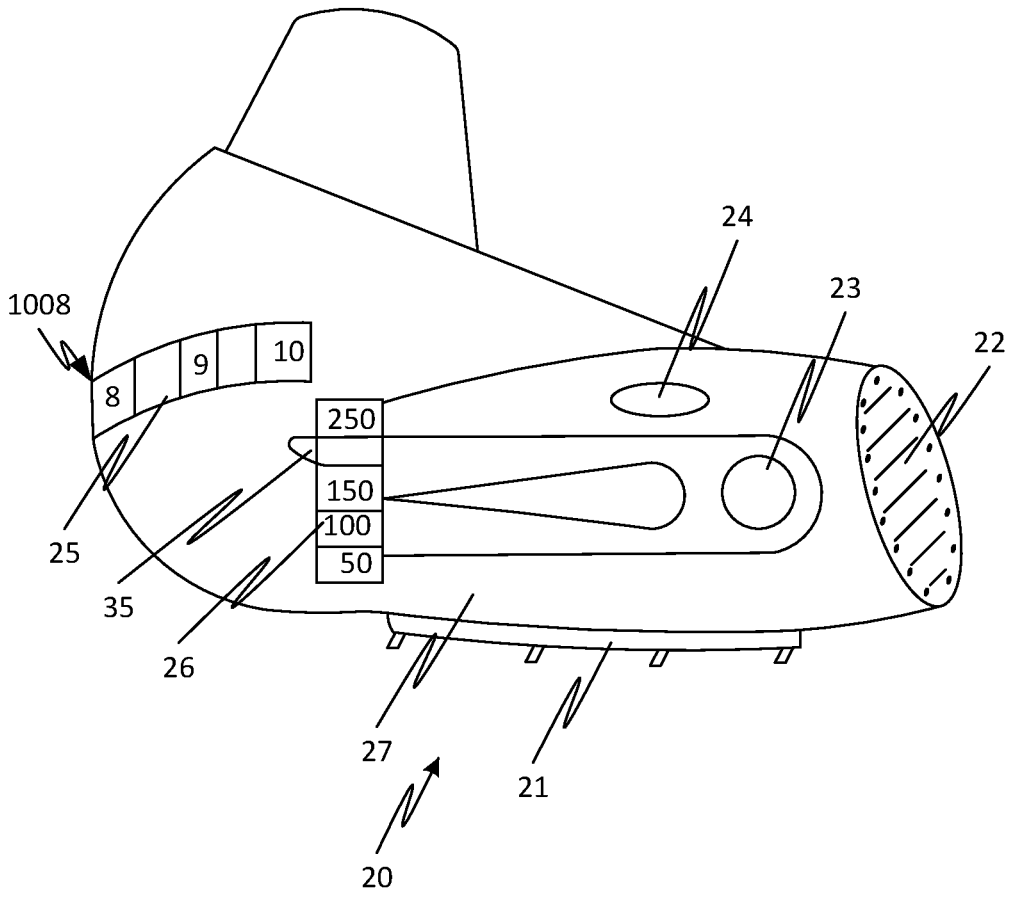
FIG. 2 is a right side view of the golf club head assembly 20, in accordance with some embodiments.

FIG. 2 is a right side view of the golf club head assembly 20, in accordance with some embodiments.

Figure 3:
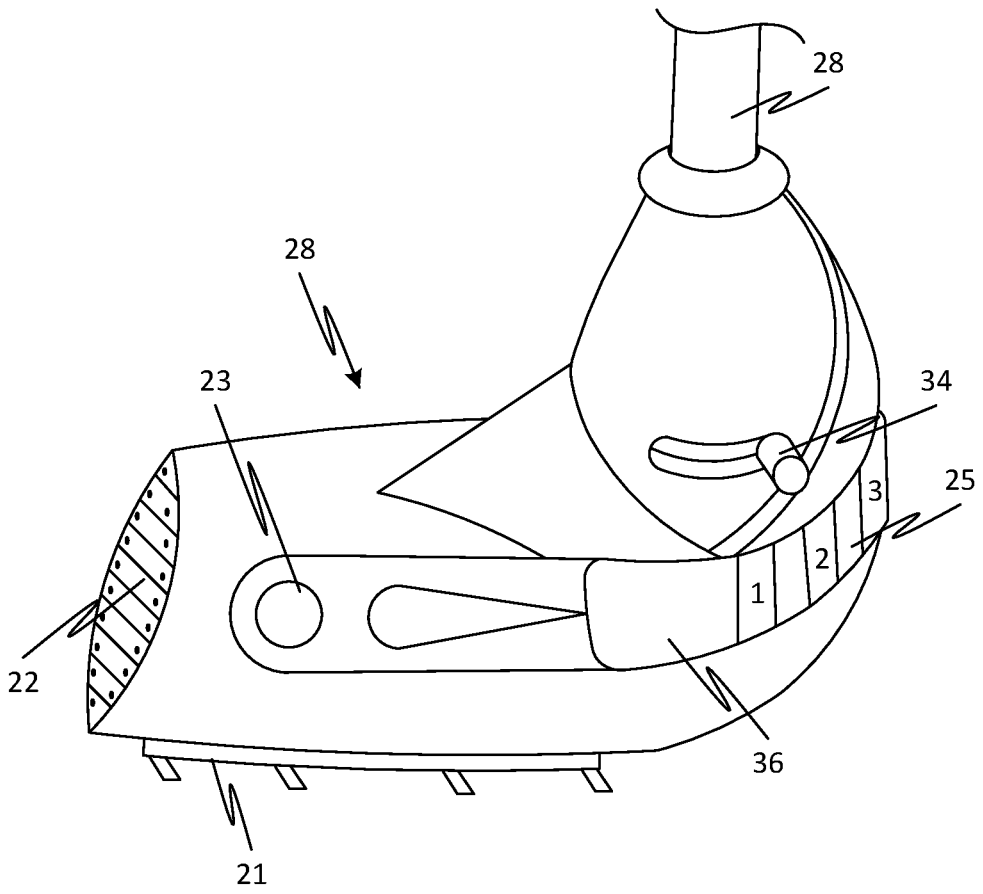
FIG. 3 is a left side view of the golf club head assembly 20, in accordance with some embodiments.

FIG. 3 is a left side view of the golf club head assembly 20, in accordance with some embodiments.

Figure 4:
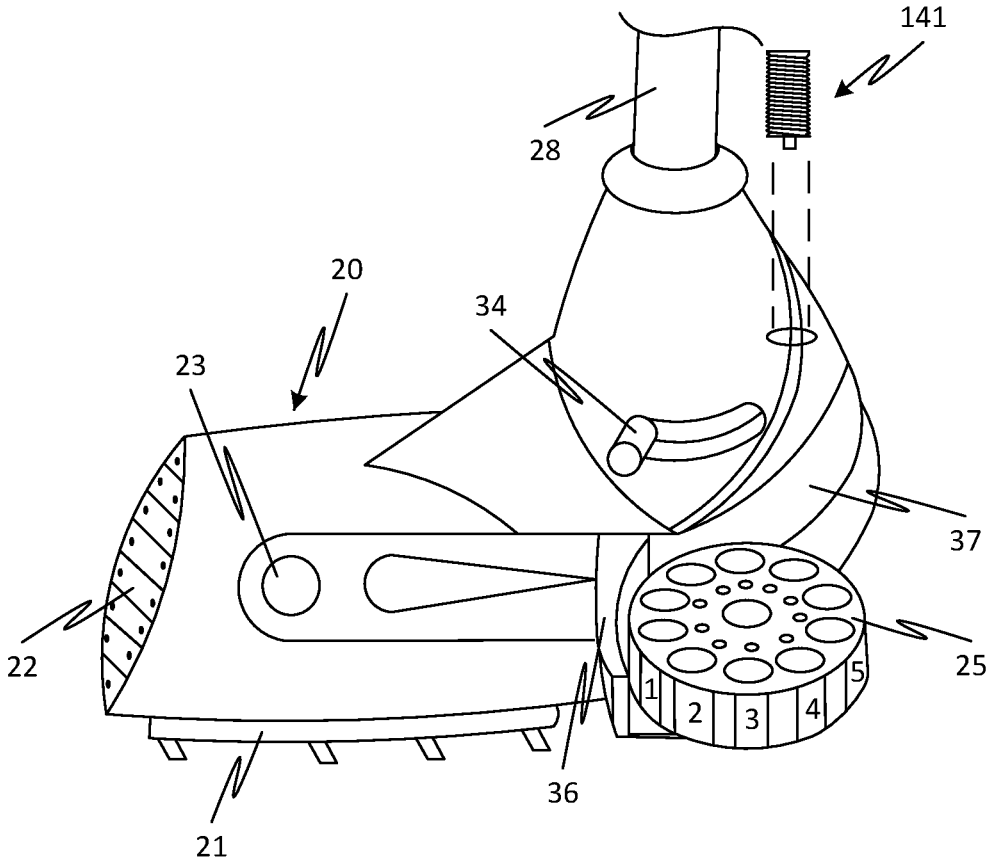
FIG. 4 is a left side view of the golf club head assembly 20 with the rotary magazine 25, in accordance with some embodiments.

FIG. 4 is a left side view of the golf club head assembly 20 with the rotary magazine 25, in accordance with some embodiments.

Figure 5:
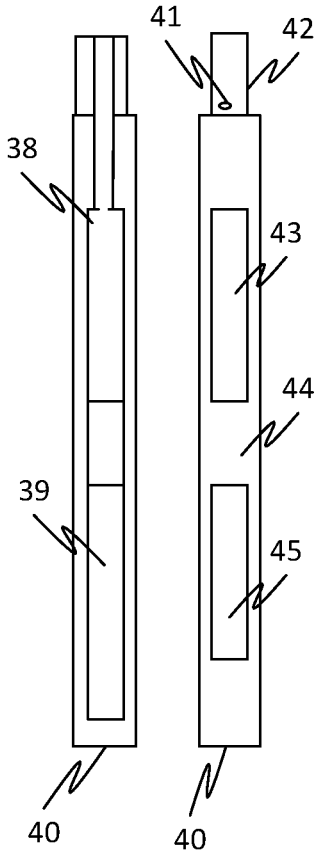
FIG. 5 is a cutaway view of the handle 1001, in accordance with some embodiments.

FIG. 5 is a cutaway view of the handle 1001, in accordance with some embodiments.

Figure 6:
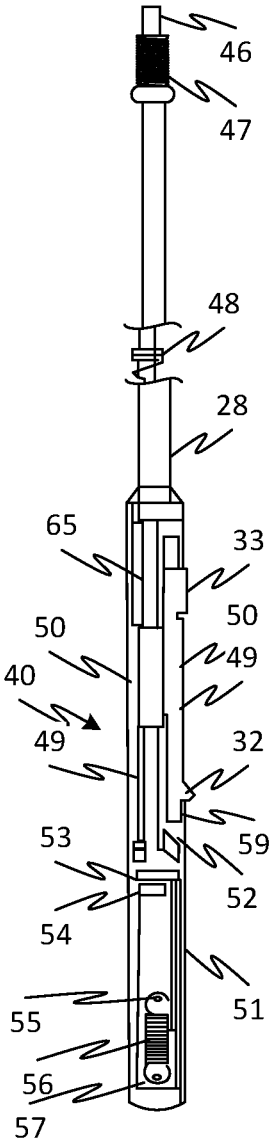
FIG. 6 is a cutaway view of the handle 1001, in accordance with some embodiments.

FIG. 6 is a cutaway view of the handle 1001, in accordance with some embodiments.

FIG. 7 is a cutaway view of the handle 1001, in accordance with some embodiments.

Figure 8:
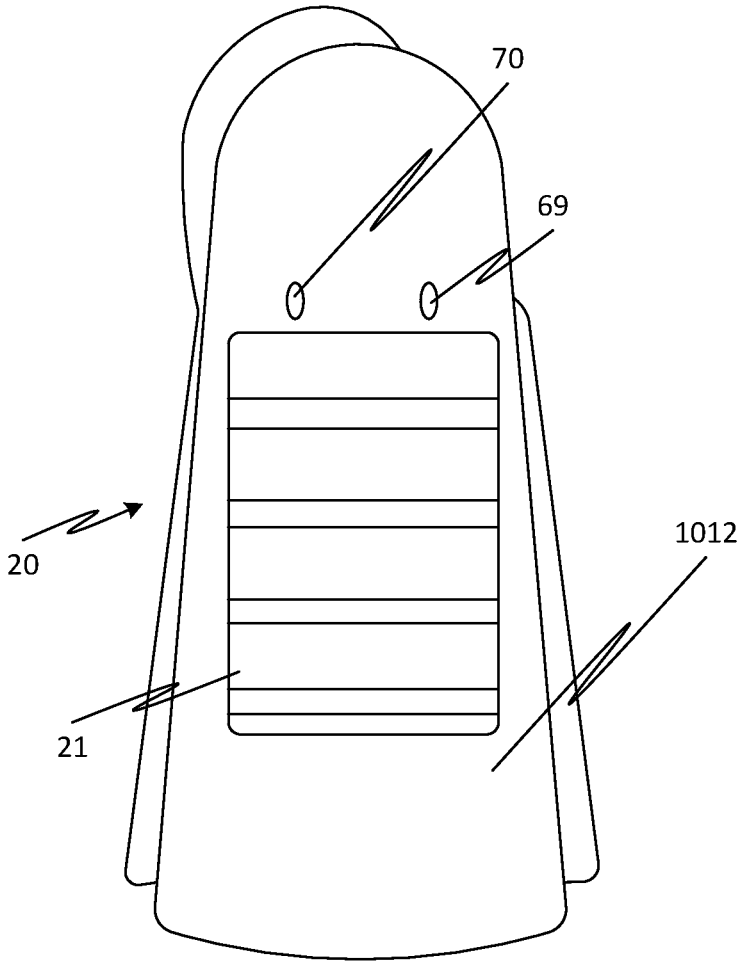
FIG. 8 is a bottom view of the golf club head assembly 20, in accordance with some embodiments.

FIG. 8 is a bottom view of the golf club head assembly 20, in accordance with some embodiments.

Figure 9:
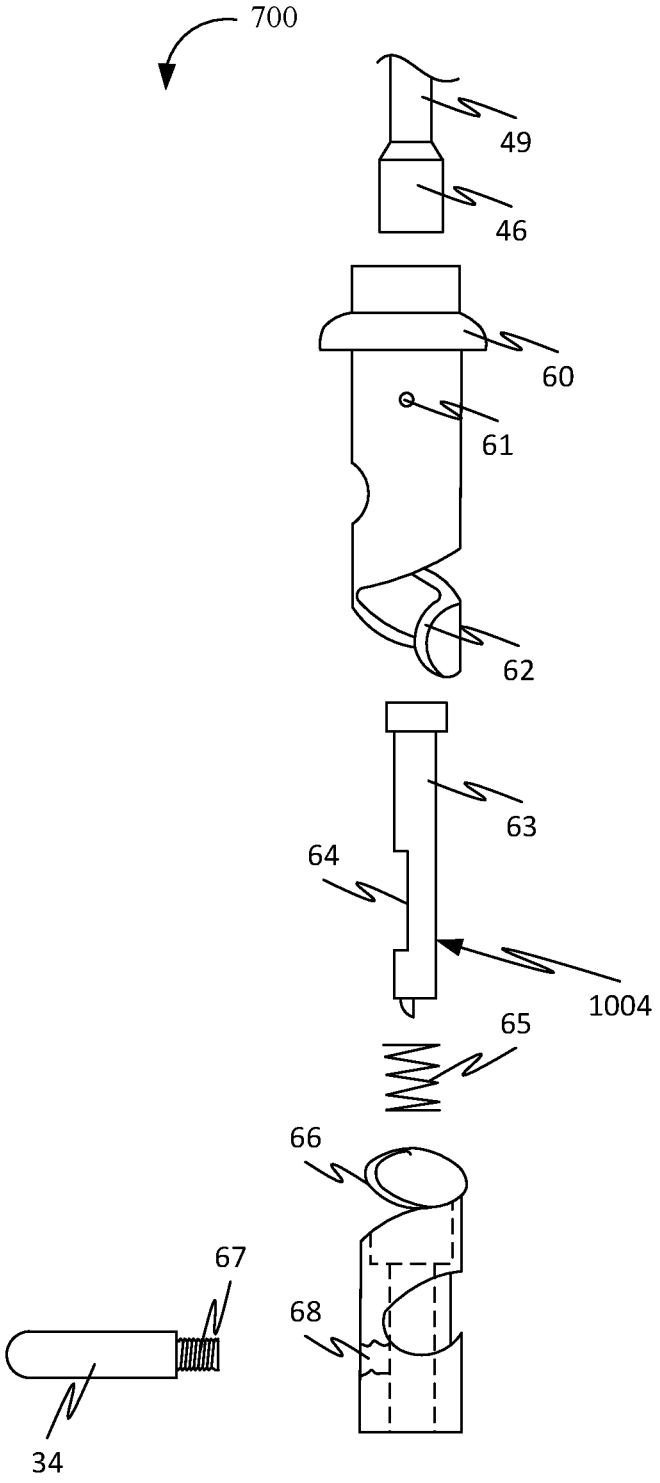
FIG. 9 is an exploded view of a firing pin cam assembly 700, in accordance with some embodiments.

FIG. 9 is an exploded view of a firing pin cam assembly 700, in accordance with some embodiments.

Figure 10:
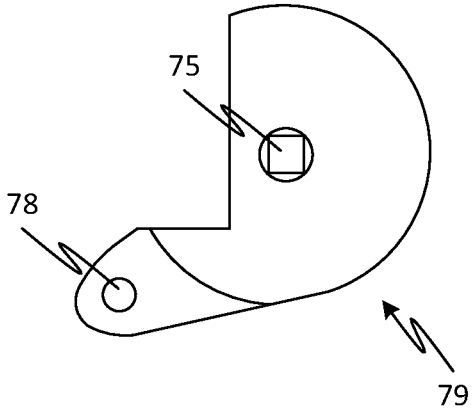
FIG. 10 is a top view of a rotary magazine carrier 79, in accordance with some embodiments.

FIG. 10 is a top view of a rotary magazine carrier 79, in accordance with some embodiments.

Figure 11:
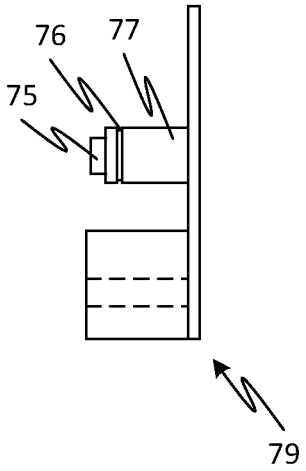
FIG. 11 is a side view of a rotary magazine carrier 79, in accordance with some embodiments.

FIG. 11 is a side view of a rotary magazine carrier 79, in accordance with some embodiments.

Figure 12:
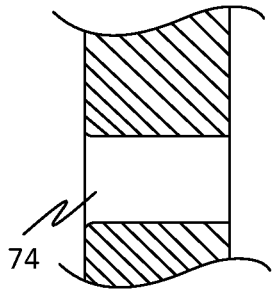
FIG. 12 illustrates the rotary magazine 25, in accordance with some embodiments.

FIG. 12 illustrates the rotary magazine 25, in accordance with some embodiments.

Figure 13:
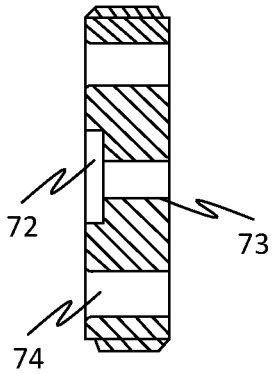
FIG. 13 illustrates the rotary magazine 25, in accordance with some embodiments.

FIG. 13 illustrates the rotary magazine 25, in accordance with some embodiments.

Figure 14:
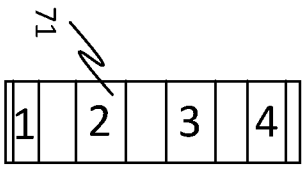
FIG. 14 illustrates the rotary magazine 25, in accordance with some embodiments.

FIG. 14 illustrates the rotary magazine 25, in accordance with some embodiments.

Figure 15:
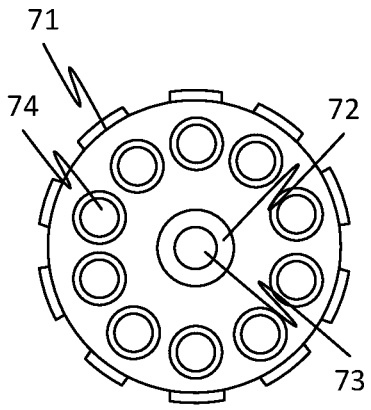
FIG. 15 illustrates the rotary magazine 25, in accordance with some embodiments.

FIG. 15 illustrates the rotary magazine 25, in accordance with some embodiments.

Figure 16:
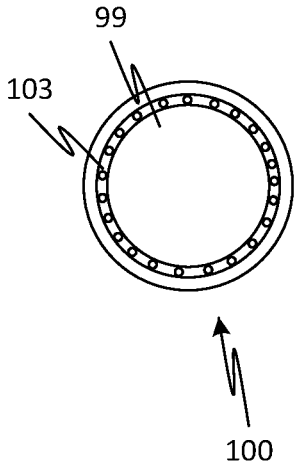
FIG. 16 is a front view of the piston 100, in accordance with some embodiments.

FIG. 16 is a front view of the piston 100, in accordance with some embodiments.

Figure 17:
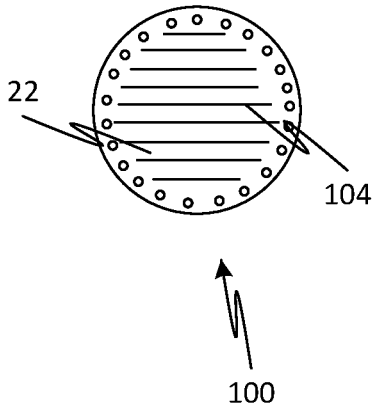
FIG. 17 is a front view of the piston 100, in accordance with some embodiments.

FIG. 17 is a front view of the piston 100, in accordance with some embodiments.

Figure 18:
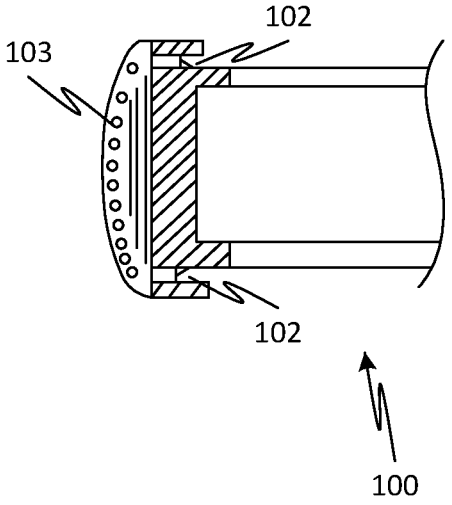
FIG. 18 is a cut away view of the piston 100, in accordance with some embodiments.

FIG. 18 is a cut away view of the piston 100, in accordance with some embodiments.

Figure 19:
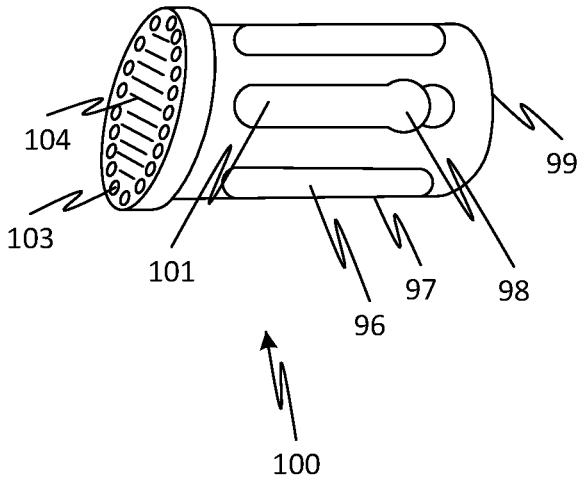
FIG. 19 is a side view of the piston 100, in accordance with some embodiments.

FIG. 19 is a side view of the piston 100, in accordance with some embodiments.

Figure 20:
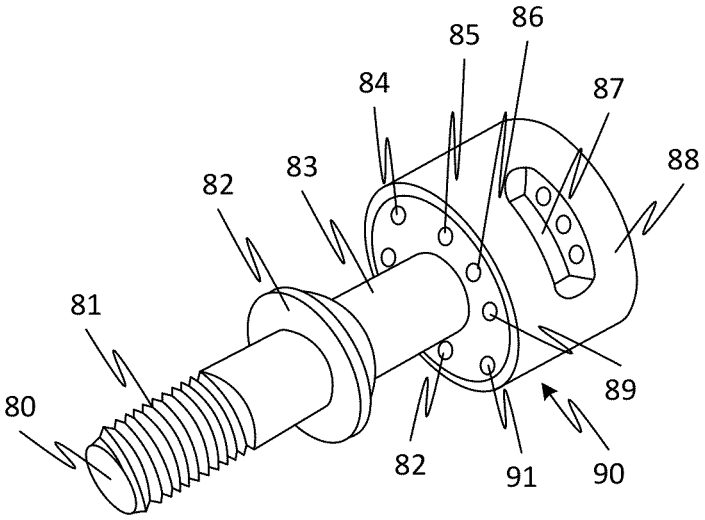
FIG. 20 is a top perspective view of the range control valve 90, in accordance with some embodiments.

FIG. 20 is a top perspective view of the range control valve 90, in accordance with some embodiments.

Figure 21:
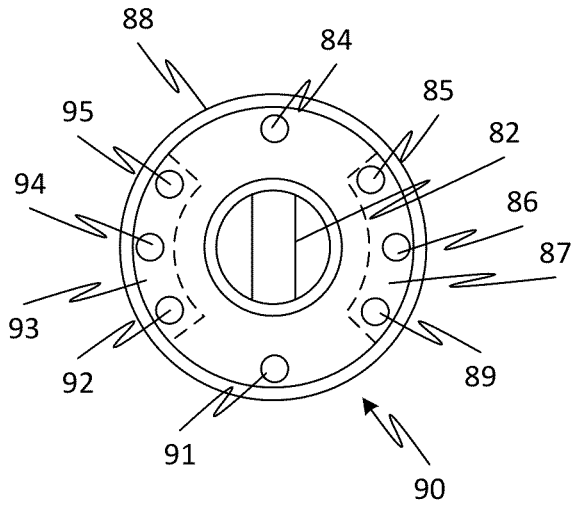
FIG. 21 illustrates the range control valve 90, in accordance with some embodiments.

FIG. 21 illustrates the range control valve 90, in accordance with some embodiments.

Figure 22:
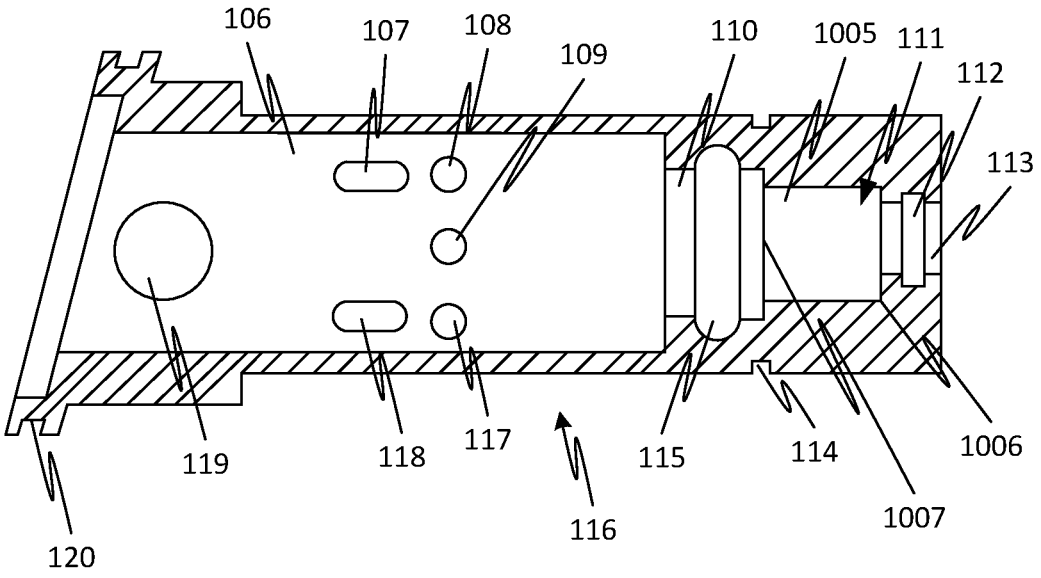
FIG. 22 is a cutaway view of the cylinder 116, in accordance with some embodiments.

FIG. 22 is a cutaway view of the cylinder 116, in accordance with some embodiments.

Figure 23:
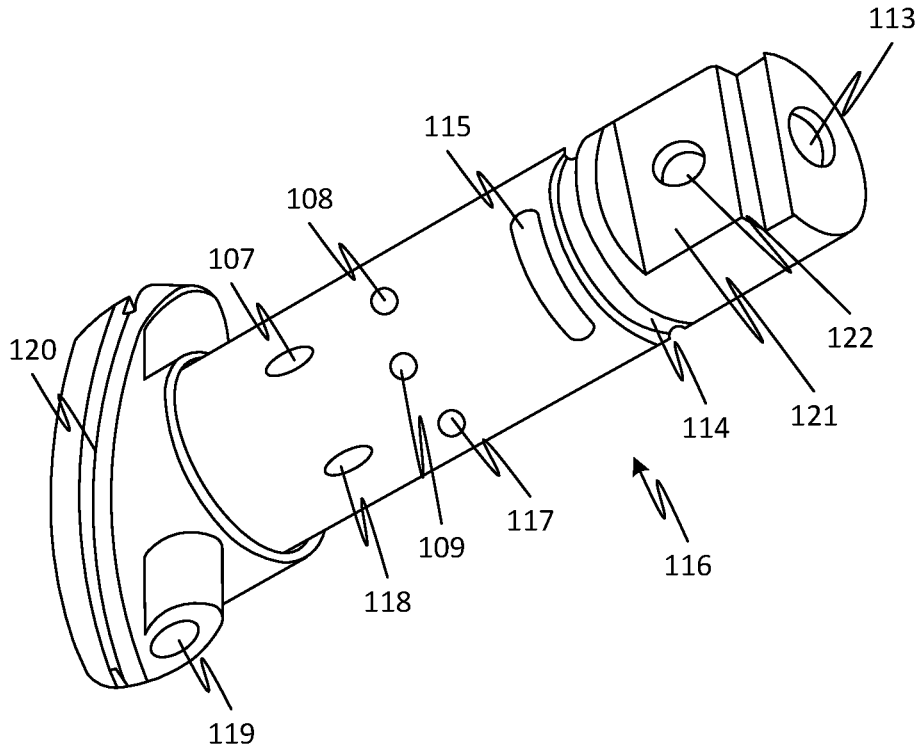
FIG. 23 is a bottom perspective view of the cylinder 116, in accordance with some embodiments.

FIG. 23 is a bottom perspective view of the cylinder 116, in accordance with some embodiments.

Figure 24:
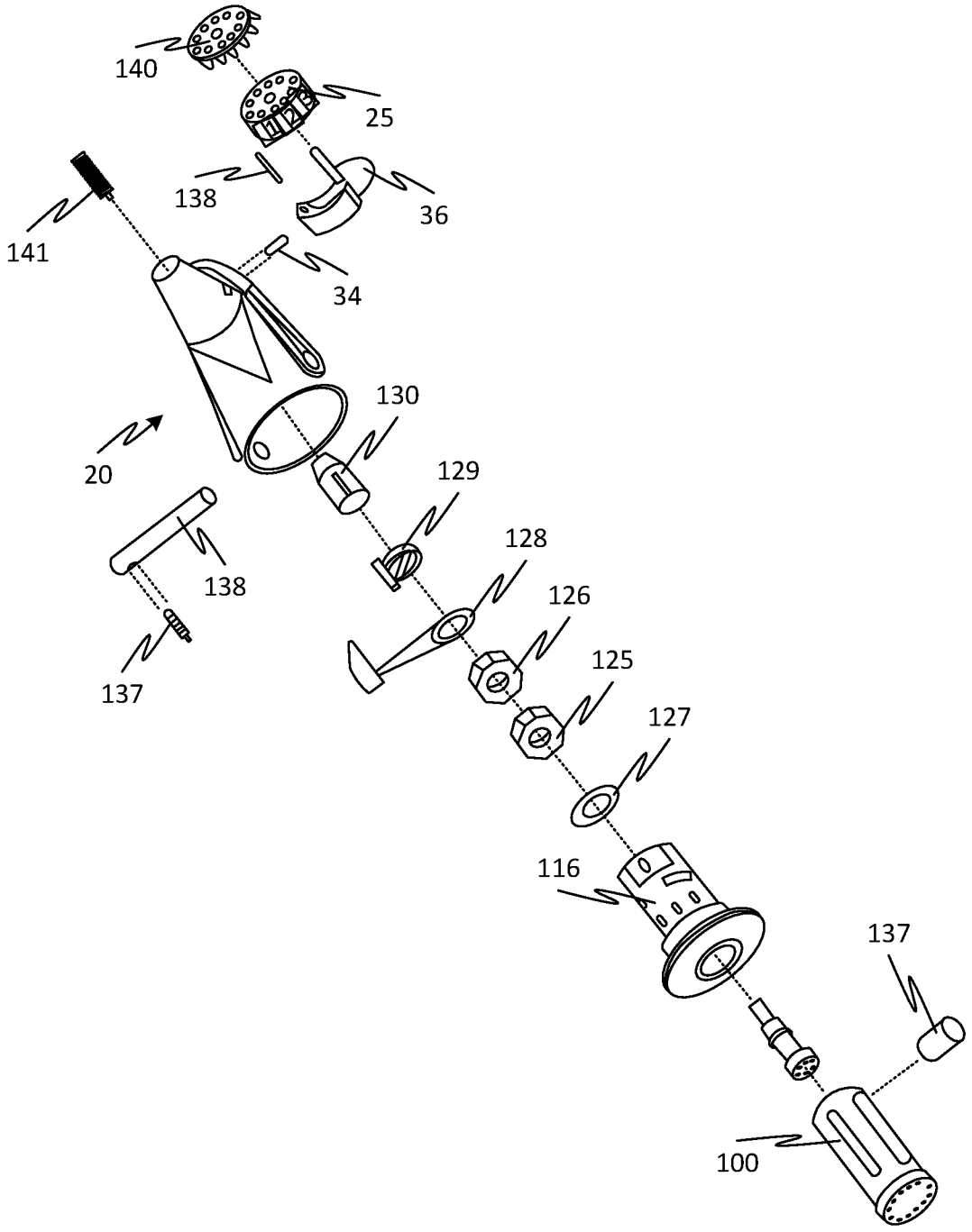
FIG. 24 is an exploded view of the golf club head assembly 20, in accordance with some embodiments.

FIG. 24 is an exploded view of the golf club head assembly 20, in accordance with some embodiments.

Figure 25:
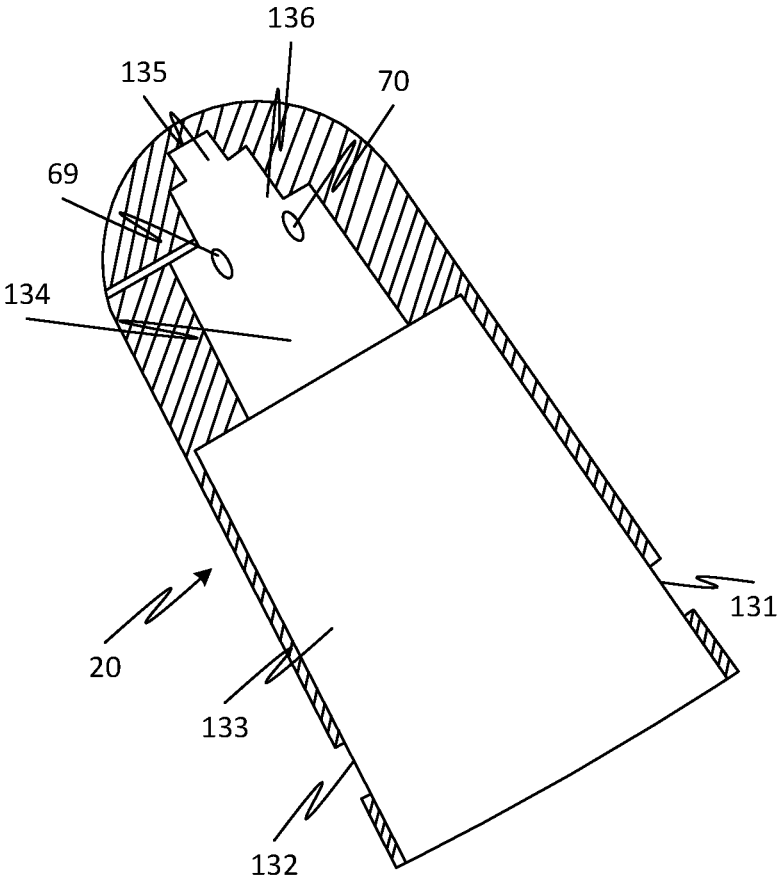
FIG. 25 is a cutaway view of the golf club head assembly 20, in accordance with some embodiments.

FIG. 25 is a cutaway view of the golf club head assembly 20, in accordance with some embodiments.

Figure 26:
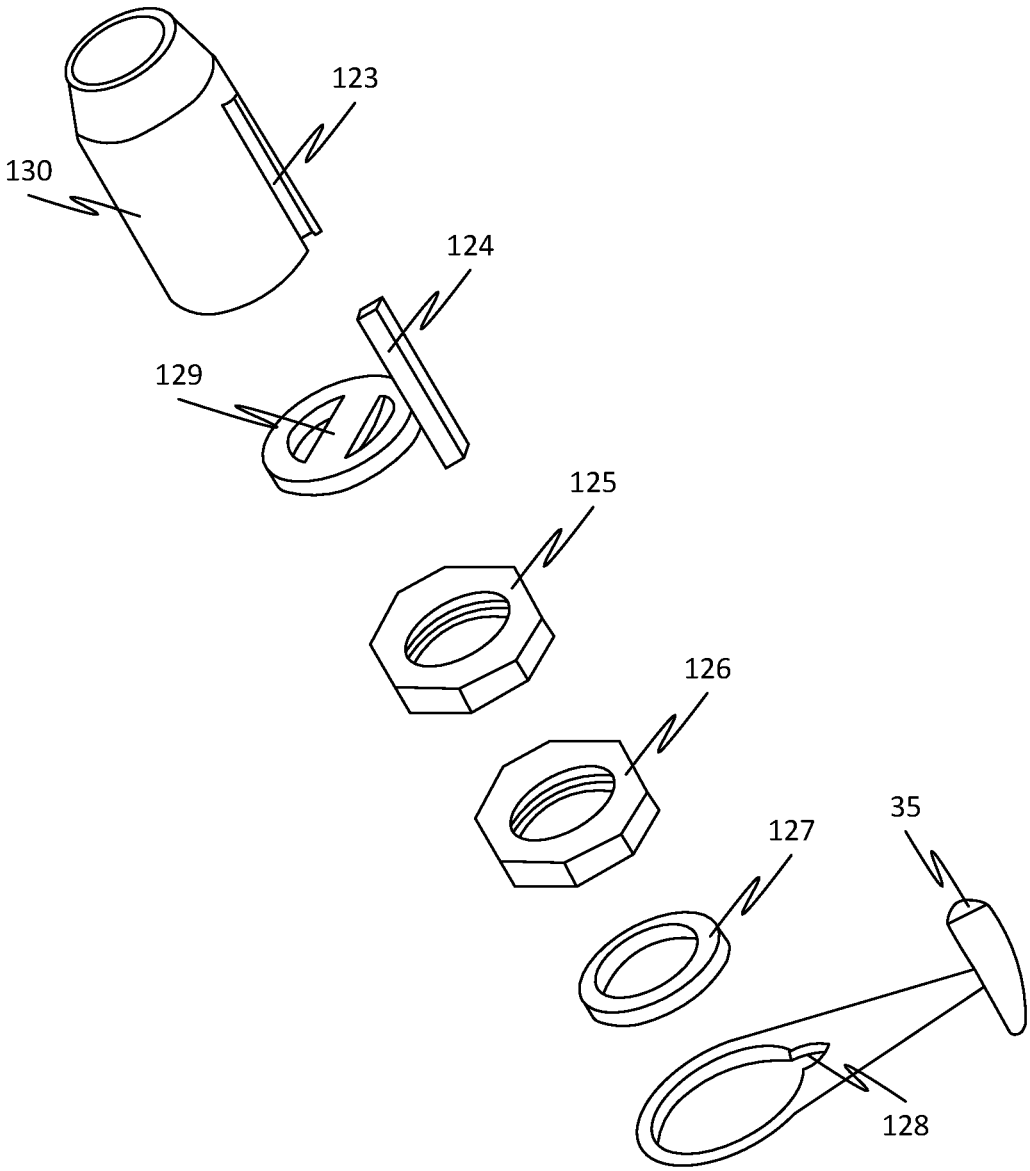
FIG. 26 is an exploded view of range control retainer parts, in accordance with some embodiments.

FIG. 26 is an exploded view of range control retainer parts, in accordance with some embodiments. Accordingly, the range control retainer parts may include the range control lever bushing groove 123, the range control lever key 124, the range control valve lock nut 125, the range control valve nut 126, the trust washer 127, the range control lever key 128, the range control key washer 129, and the range control lever bushing 130.

Figure 27:
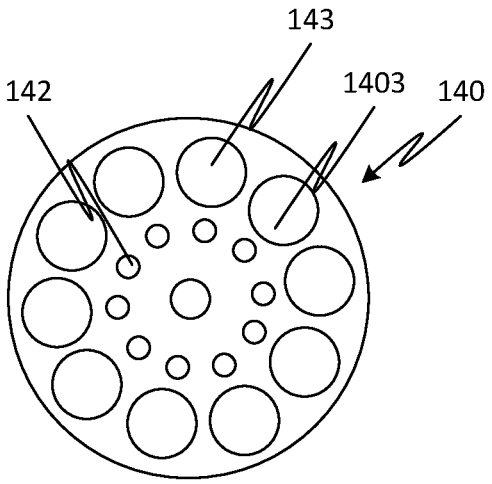
FIG. 27 is a top view of the at least one reloadable wafer 140, in accordance with some embodiments.

FIG. 27 is a top view of the at least one reloadable wafer 140, in accordance with some embodiments.

Figure 28:
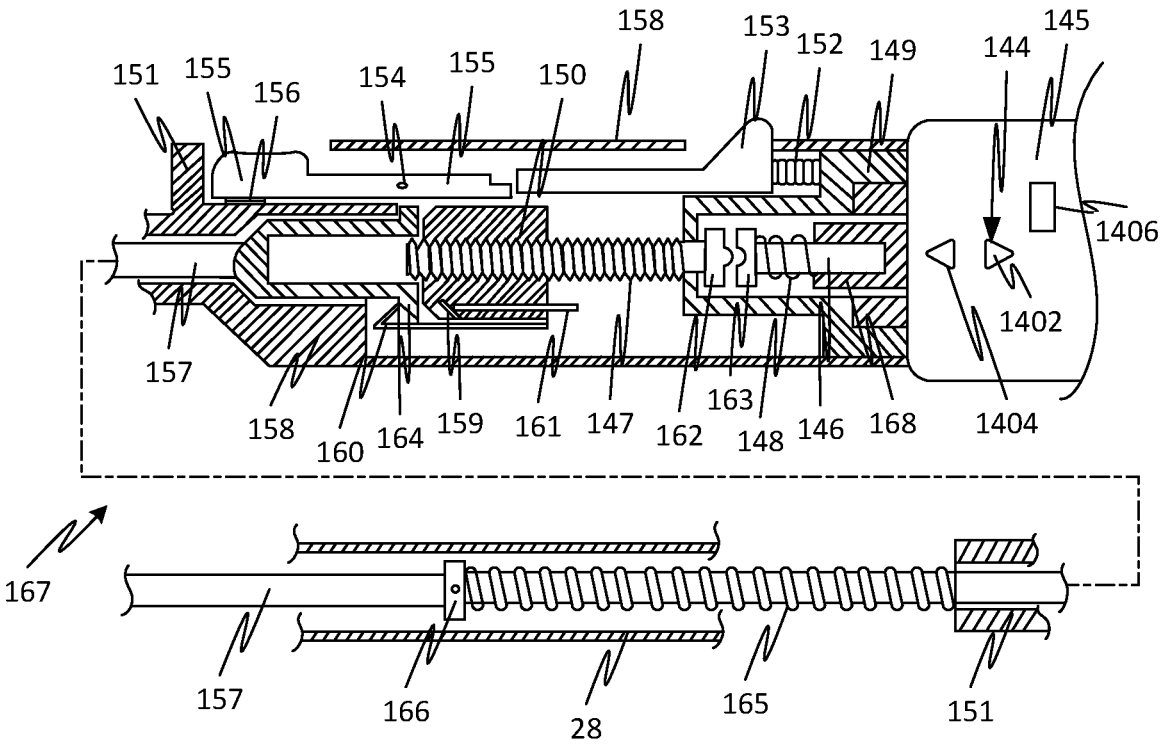
FIG. 28 is a cutaway view of the motorized handle 167 in an uncocked state, in accordance with some embodiments.

FIG. 28 is a cutaway view of the motorized handle 167 in an uncocked state, in accordance with some embodiments. Accordingly, the motorized handle 167 transitions to the uncocked state after firing the cartridge.

Figure 29:
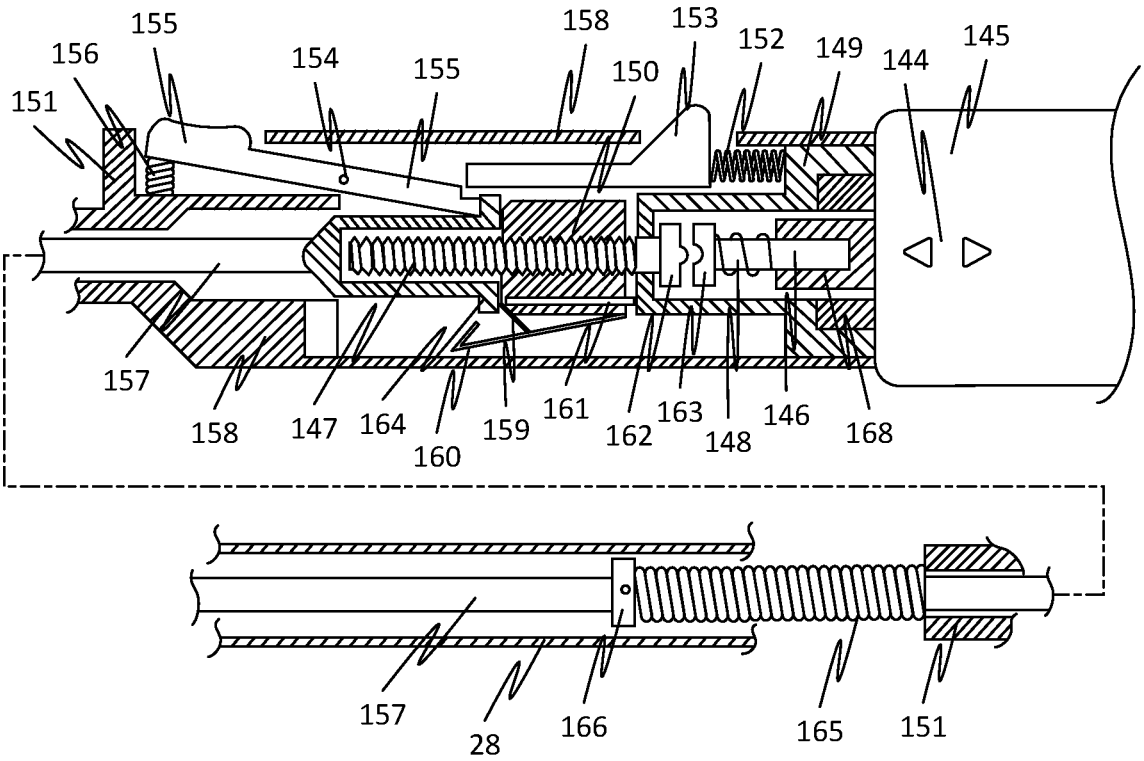
FIG. 29 is a cutaway view of the motorized handle 167 in a cocked state, in accordance with some embodiments.

FIG. 29 is a cutaway view of the motorized handle 167 in a cocked state, in accordance with some embodiments. Accordingly, the motorized handle 167 in the cocked state is ready/prepared to fire the second cartridge.

The typical golf club illustrated in FIG. 1 is completely assembled and ready for use. FIG. 1 through FIG. 29 clearly illustrate each component part interconnection. The golf club embodiment 20 has a cylinder 116 containing a striker/piston 100 shown in the retracted position in FIG. 1 through FIG. 4. FIG. 5 shows a cut away view of the manual version of handle 40 containing the trigger and safety slide in the lower portion and the cocking grip or sleeve in the upper portion of handle 30.

Operation of FIGS. 1-29

In the present invention, those skilled in the art will understand the mechanical sequence described to launch a golf ball 139 from a golf club, utilizing a gun powder cartridge from a static position without swinging the club. With the golf club illustrated in FIG. 1 sitting in an upright position with shaft magazine 25 fully loaded with a series of cartridges, a user places the golf club head embodiment 20 adjacent to the golf ball 139. To launch the golf ball 139 maximum distances toward the golf course green, a safety button 32 is actuated, thereby enabling a firing trigger 33 to be pressed, firing a selected cartridge 143. Before loading or reloading rotary magazine 25, manual version, cocking handle 31 must be lifted fully upward and released, being returned by the cocking handle sleeve return spring 56, to cock firing pin spring 48, in preparation for firing the golf club.

Loading the cartridge wafer 140 into rotary magazine 25 is accomplished by releasing a firing assembly cam lever 34 and pressing rotary magazine 25 outward from the rotary magazine housing 37 on hinge pivot 78, thereby providing clearance for loading or reloading cartridge wafer 140 from rotary magazine 25. Reversing the process of a rotary magazine 25 returns cartridge wafer 140 back into rotary magazine housing 37 whereby a selected cartridge wafer index detent 142 becomes engaged with detent spring ball 141. Before firing golf club 20 the user rotates a firing pin housing cam rotor 66 by pressing a firing pin housing lever 34 firmly forward, which seats firing pin cam rotor 66 on the top of selected cartridge 143.

The distance adjuster indicator lever 35 is positioned on a ball travel scale 26 to the desired range a ball is expected to travel. The golf club handle 30 is placed in an upright position with the golf club head embodiment 20 adjacent to golf ball 139. The user places both hands on a golf club handle grip 29 in a conventional manner with the left thumb on a thumb safety button 32 and the right thumb on a firing trigger 33. Pulling upward on the safety button 32 and pressing the firing button 33 fires a selected cartridge in cartridge wafer 140 of golf club embodiment 20. The operational sequence of parts of the manual version of golf club embodiment 20 after the actuation of safety slide 32 and firing trigger button 33, which releases linkage rod 49 after trigger releases latching pawl 58. This allows firing pin spring 48 to release the stored kinetic energy in firing pin spring 48 forcing firing pin hammer 46 to strike firing pin 63, thereby firing selected cartridge 143 in cartridge wafer.

High-pressure gas generated from cartridge 143 flows into the vortex generator chamber 111, plated with platinum, rhodium, and *Caladium*, creating a super burn rate, designed to burn a large portion of powder residue before entering the range control valve 90, range control vent down chamber 87 depending on the position of range control valve 90 setting on range control distant scale 26, high-pressure gas will be dispersed in a ratio, thereby applying more or less pressure to striker/piston 100, more precisely to piston end 99 of the striker/piston 100. The high-pressure gas "blow by" around the circumference clearance of striker/piston 100 and cylinder bore 106 after firing, flows into the gas reversal thruster silencer ring 102, which reduces the DB level as the high-pressure gas is filtered through gas reversal thruster ports 103, adding additional momentum to striker/piston 100.

The firing process forces striker/piston 100 to drive the golf ball 139 and at the end of the travel stroke striker/piston 100 is restrained in the manual version handle 40 by stop spring snubber 137 contacting stop pin 158 in the manual version, and by the bending action of the stop pin urethane material in an alternate motorized cocking handle 167. The reaction of golf club embodiment 20 resists the aft recoil motion by an anti-skid cleat plate 21 mounted on a bottom of golf club 20. Stop pin 158 secures golf club (embodiment) 20 by means of a stop pin hole in cylinder 116, which is held in place by spring ball 137.

Further, the range control valve shaft 83 is plated with platinum, rhodium, and *Caladium* to create a super burn rate in the vortex generator, splitting the gas to cause a circular spinning vortex forcing the gas to meet from opposite directions before entering the range control valve 90. The vortex gas flow pattern enters the range control valve 90, which further shapes the vortex flow pattern, where the range control valve 90 is designed to maintain the optimum temperature throughout the linear degrees of pressure change required for a given distance setting.

Depending upon the position of vortex generator range control shaft 83 the gas flow is proportionally dispersed with an exact ratio, into cylinder 106 on to the top of piston 99 and or into golf club casting silencing chamber 133. This action allows high-pressure gas to expand thereby lowering the venting velocity of the high-pressure gas to an acceptable DB level. The maximum distance setting on ball travel distance scale 26 allows the maximum gas flow into cylinder 106 applying full pressure to the piston end of striker/piston 99. The striker/piston 100 slides on the striker/piston bearing surface of striker piston lands 96 and striker piston grooves 97 consisting of a hard anodized Teflon impregnated or ceramic coating, a given distance before exposing cylinder pre-exhaust ports 108,109,117 and exhaust ports 107,118.

The clubs with the motorized cocking handle 167, fire in the same manner as the manual cocking handle 40 version, except for the cocking method being motorized. Starting with golf club handle 167 in the unfired state FIG. 18, the first function is to cock golf club handle 167 by activating cocking motor 145. Each end of a motorized handle motor switch 144 rotates motor shaft 146. Pressing the lower end of the motor switch 144, rotates drive screw 147 CCW moving a cocking actuator 150 in a downward direction by means of drive screw 147 moving through the centered threaded bore of the actuator 150, landing against the end limit of motorized handle 167 housing, thereby locking drive screw 147. The operator senses the downward movement is complete, there by releasing motor switch 144. The cocking actuator 150 moved cocking engagement spring 160 into the latched position with cocking latching pawl 164. The operator presses the top end of the motor switch 144, which rotates drive screw 147 in the CW rotation, thereby retracting the cocking latching pawl 164, moving firing linkage rod, compressing a main firing pin spring 165 to become latched by trigger return spring forces firing trigger 155, to capture the latching pawl 164 after being released by engagement spring release rod 161 actuation. The motorized handle 167 is cocked ready to fire. To fire the motorized handle 167; slide a safety button 153 upward, compressing a return spring 152 in the safety slide button 153, which allows a firing trigger 155 to be actuated. When the firing trigger 155 is actuated, the latching pawl 164 is released. This allows the compressed firing spring 165 on firing pin linkage rod 157 to release and convert stored kinetic energy into mechanical force, to strike firing pin 63 penetrating cartridge 143 in cartridge wafer 140.

As a first aspect of present invention, a golf club apparatus capable of driving a golf ball varying distances from a static position without swinging the club comprises: an embodiment, a firing cylinder, and a rotary magazine containing a series of gun powder cartridges, in a consumable, reloadable wafer; a valve arrangement for controlling flow of high-pressure gas injected into the cylinder, wherein the embodiment to actuate a striker/piston to drive a golf ball; a cylinder containing a super burner vortex generator, extends through the central longitudinally axis of the embodiment bore, between two "O" rings forming a silencing chamber. A method of operating the apparatus comprises a safety actuated triggering device for firing selected gun powder cartages and a passageway for directing high-pressure gas to the breech end of the cylinder, controlled by an adjustable setting lever.

As a second aspect based on the first aspect, the apparatus further includes a one-piece striker/piston retained in a cylinder.

As a third aspect based on the first aspect, the apparatus further includes a one-piece striker/piston, employing a full diameter, mated inside a cylinder bore with a slide fit tolerance.

As a fourth aspect based on the third aspect, the apparatus further provides a means for a one-piece striker/piston, to travel a longitudinal axis inside a cylinder bore with a slide fit tolerance.

As a fifth aspect based on the first aspect, the apparatus further includes a one-piece striker/piston, riding on a hard anodized Teflon impregnated or ceramic coating, employing raised lands and grooves.

As a sixth aspect based on the second aspect, the apparatus further comprises a striker/piston with a floating urethane spring material, riding in a longitudinal slot, with a tapered end recess.

As a seventh aspect based on the sixth aspect, the apparatus further comprises an optional means of a striker/piston with a urethane spring material, extending through a longitudinal slot, over a cam radius at the piston end recess, with each end anchored to embodiment bosses.

As an eighth aspect based on the fourth aspect, the apparatus further includes a solid one piece constructed striker/piston, providing a constant equal diameter from the piston end, continuing to the striker face, comprising a larger diameter grooved thruster ring.

As a ninth aspect based on the eighth aspect, the apparatus further comprises a larger diameter thruster ring containing a plurality of DB reducing ports.

As a tenth aspect based on the first aspect, the apparatus further comprises a rotary magazine for storing a wafer of gun powder cartridges.

As an eleventh aspect based on the tenth aspect, the apparatus further comprises a visual indication of the number of wafer cartridges loaded remaining to be consumed.

As a twelfth aspect based on the first aspect, the apparatus further includes a one-piece club head embodiment casting shaped for die casting, as opposed to investment casting.

As a thirteenth aspect based on the twelfth aspect, the one-piece embodiment bore comprises a silencing chamber cavity formed between two "O" rings on each end of the cylinder.

As a fourteenth aspect based on the thirteenth aspect, the apparatus further comprises a range control valve disposed in vortex generator breech end of the cylinder.

As a fifteenth aspect based on the fourteenth aspect, the apparatus further comprises a super burner vortex generator chamber cavity and shaft, plated with platinum, rhodium and *Caladium*.

As a sixteenth aspect based on the fifteenth aspect, the apparatus further comprises a high-pressure ratio adjuster valve lever.

As a seventeenth aspect based on the fourteenth aspect, the apparatus further comprises a series of vent down ports.

As an eighteenth aspect based on the first aspect, the apparatus further comprises a golf club shaft handle therein providing a housing, for a firing pin hold-down cam assembly.

As a nineteenth aspect based on the eighteenth aspect, the apparatus further includes a means to selectively compress and decompress a firing pin spring to convert potential stored energy into kinetic energy upon the triggered spring release.

As a twentieth aspect based on the nineteenth aspect, therein provides a triggering means to release stored spring energy.

As a twenty-first aspect of the present invention, a golf club apparatus capable of driving a golf ball varying distances from a static position without swinging the club comprises a one-piece golf club head die casting embodiment; with a cylinder extending through a center line bore, with two "O" rings encasing the cylinder, forming a silencing chamber; a one piece die casting embodiment, containing a rotary magazine for storing a plurality of cartridges; utilizing a consumable cartridge wafer; fired by a rotary hold down cam firing pin, housed within the connecting end of a motorized cocking golf club handle shaft, attached to the club head; therein the handle contains a safety and trigger adapted to fire the cartridges in a magazine wafer.

As a twenty-second aspect based on the twenty-first aspect, therein comprises a safety for triggering release of stored spring energy.

As a twenty-third aspect based on the twenty-first aspect, the apparatus further comprises a firing pin spring latched in a compressed state by force of firing trigger return spring.

As a twenty-fourth aspect based on the twenty-first aspect, the apparatus further includes a vertex chamber, which contain a range control valve vertex shaft, thereby forming a displacement, to provide for expanding gas pressure to accelerate the striker piston in a selected ratio.

As a twenty-fifth aspect based on the first aspect, a rotary magazine mates sealed and centered over the cylinder inlet port, held in position by a spring ball seated into the cartridge wafer detent hole.

As a twenty-sixth aspect based on the twenty-fourth aspect, a firing pin cam rotor hold-down lever provides a mechanical sealing force between the firing chamber discharge port and cylinder inlet port.

As a twenty-seventh aspect based on the first aspect, the apparatus further includes an embodiment side mounted ball travel distance scale.

As a twenty-eighth aspect based on the twenty-seventh aspect, the apparatus provides a visual indication a golf ball will travel, by rotating vortex generator armature, by means of a distance adjuster indicator lever.

As a twenty-ninth aspect based on the first aspect, the apparatus further comprises a handle containing a hollow shaft, containing a firing pin linkage rod coupled with a firing pin spring; a means released by a firing trigger, projecting a firing pin, to penetrate the cartridge on command.

As a thirtieth aspect based on the first aspect, the apparatus further includes a handle frame, comprising a safety-controlled trigger; a manual cocking operation provided by the upper portion of the golf club handle grip.

As a thirty-first aspect based on the thirtieth aspect, the upper grip slides in a longitudinal direction on handle body; thereby moving the firing pin linkage rod into a latching position in the first direction and returned by a spring in the opposite direction.

As a thirty-second aspect based on the first aspect, the apparatus further includes a rotary magazine adapted to a swing in and out reloading carrier.

As a thirty-third aspect based on the first aspect, the apparatus further includes a plurality of firing ports in a range control valve; sized to create a predetermined high-pressure ratio distribution.

As a thirty-fourth aspect based on the first aspect, the apparatus further includes a gas reversal thruster ring, whereby expanding gas bypassing the piston, enters a protruding ring groove, shaped to reverse the expanding gas flow in the opposite direction adding more thrust to the striker/piston.

As a thirty-fifth aspect based on the first aspect, the apparatus further comprises a vortex generator chamber, located in the aft end of the firing cylinder, to provide a means to force burning gun powder gas into a vortex pattern, thereby sending unburned gun powder back into the burning incoming gun powder.

As a thirty-sixth aspect based on the thirty-fifth aspect, the apparatus further includes a vortex generator chamber plated with platinum, rhodium and *Caladium* to create a super burn rate of gun powder residue.

As a thirty-seventh aspect based on the first aspect, the apparatus further includes a gas receiving multi-port armature to provide a linear dispersing path through mating ports, where the armature rotates around a longitudinal axis connected to a shaft, that extends through the cylinder to a distance adjuster indicator lever.

As a thirty-eighth aspect based on the thirty-seventh aspect, the apparatus is designed to float on a bushing, whereby the lever protrudes through the side of the golf club die casting embodiment, comprising a graduated scale indicating the degree of rotation of the armature, thereby producing a given travel distance of a golf ball.

As a thirty-ninth aspect based on the thirty-eighth aspect, the apparatus further includes a vortex generator shaft extending through a cylinder stem hole, where the shaft provides a threaded mounting stud for anchoring the vortex generator against a thrust bearing, onto the aft end of the cylinder.

As a fortieth aspect based on the thirty-ninth aspect, the apparatus further includes a shaft end containing a key slot and extending through said bushing, through floating distance adjuster indicator lever.

As a forty-first aspect based on the first aspect, the apparatus further includes a hard anodized Teflon impregnated coating or ceramic coating, to provide a bearing surface lubrication means for the striker/piston.

As a forty-second aspect based on the twenty-first aspect, the apparatus further comprises a bi-directional battery-operated cocking drive motor.

As a forty-third aspect based on the forty-second, the apparatus further includes a spring-loaded clutch worm drive.

As a forty-fourth aspect based on the forty-third aspect, the apparatus further includes a safety triggering release of a firing pin spring.

As a forty-fifth aspect based on the forty-fourth aspect, the apparatus further includes flat spring cocking latch, comprising a latch release rod.

As a forty-sixth aspect based on the forty-fifth aspect, the apparatus includes a cocking actuator.

Although the present disclosure has been explained in relation to its preferred embodiment, it is to be understood that many other possible modifications and variations can be made without departing from the spirit and scope of the disclosure.

What is claimed is:

1. A propellent-driven golf club to launch a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism; and a golf club head assembly attached to a bottom portion of the hollow shaft, wherein the golf club head assembly comprises:

a rotary magazine configured to receive at least one reloadable wafer, wherein the rotary magazine is rotatable about a hinge pivot, wherein the at least one reloadable wafer comprises a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to force the gas to meet from opposite directions;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve; and a piston movably disposed in the firing cylinder bore, wherein the gases drive the piston, wherein a free end of the piston is configured to strike the ball.

2. The propellent-driven golf club of claim 1, wherein the golf club head assembly comprises a urethane spring brake extending horizontally in a longitudinal slot comprised in the firing cylinder bore, wherein the piston stops against the urethane spring brake after launching the ball, wherein the urethane spring brake is configured for absorbing a kinetic energy of the piston for stopping the piston, wherein the urethane spring brake deforms based on the piston stopping against the urethane spring brake.

3. The propellent-driven golf club of claim 1 further comprises Ballistol lubricant applied on at least one of the piston and the firing cylinder bore for reducing friction between the piston and the firing cylinder bore, wherein the reducing of the friction between the piston and the firing cylinder bore facilitates driving of the piston.

4. The propellent-driven golf club of claim 1, wherein the handle comprises a motorized handle mechanically coupled with the firing mechanism, wherein the motorized handle comprises:

at least one motor switch comprising a top switch and a lower switch, wherein each of the top switch and the lower switch is configured to be transitioned between a switch pressed state and a switch raised state;

an actuating motor configured for rotating a drive screw based on a state of the at least one switch, wherein the top switch in the switch pressed state causes clockwise rotation of the drive screw, wherein the lower switch in the switch pressed state causes counter-clockwise rotation of the drive screw;

a cocking actuator operationally coupled with the drive screw, wherein the cocking actuator is configured to be transitioned between an actuator top position and an actuator bottom position based on the rotating of the drive screw, wherein the cocking actuator traverses from the actuator top position to the actuator bottom position based on the counter-clockwise rotation of the drive screw, wherein the cocking actuator traverses from the actuator bottom position to the actuator top position based on the clockwise rotation of the drive screw; and a rechargeable power source electrically coupled with the actuating motor, wherein the rechargeable power source is configured for providing electrical power to the actuating motor, wherein a motorized firing pin spring comprised in the firing mechanism is compressed based on the cocking actuator reaching the actuator top position, wherein the firing mechanism is ready to fire the cartridge based on compressing of the motorized firing pin spring.

5. The propellent-driven golf club of claim 1, wherein the golf club head assembly further comprises a rotary magazine housing configured to accommodate the rotary magazine, wherein the rotary magazine housing is rotatable about the hinge pivot, wherein the rotary magazine housing is configured for transitioning between an extended state and a retracted state, wherein the rotary magazine housing in the extended state facilitates reloading of the at least one reloadable wafer, wherein the rotary magazine housing in the retracted state facilitates orienting the cartridge in a firing position ready to be fired by the firing mechanism.

6. The propellent-driven golf club of claim 1, wherein the golf club head assembly further comprises:

a firing pin housing lever configured to be pressed forward for transitioning the firing pin housing lever to an activated state from a deactivated state based on a user pressing action performed by a user to facilitate reloading of the propellent-driven golf club, wherein the reloading of the propellent-driven golf club comprises positioning a second cartridge of the plurality of cartridges to a firing position after firing of the cartridge; and a firing pin housing cam rotor operationally coupled with the firing pin housing lever, wherein the firing pin housing cam rotor configured to be rotated based on a user rotating action, wherein the user rotating action positions the firing pin housing cam rotor on top of the second cartridge to be fired, wherein the transitioning of the firing pin housing lever to the activated state followed by the user rotating action positions the second cartridge to the firing position, wherein the firing mechanism is configured for firing the second cartridge in the firing position.

7. The propellent-driven golf club of claim 1, wherein the handle comprises an upper cocking handle mechanically coupled with the firing mechanism, wherein the upper cocking handle is configured to be transitioned between a lifted state and a resting state using a cocking handle sleeve return spring, wherein the transitioning of the upper cocking handle from the resting state to the lifted state is based on a lifting action performed by a user, wherein the transitioning of the upper cocking handle from the lifted state to the resting state is based on the cocking handle sleeve return spring, wherein the transitioning of the upper cocking handle from the lifted state to the resting state cocks a firing pin spring comprised in the firing mechanism, wherein cocking of the firing pin spring corresponds to preparing the firing mechanism for firing the cartridge.

8. The propellent-driven golf club of claim 1, wherein the range control mechanism further comprises a range control lever and a ball travel scale, wherein the range control lever is disposed proximal to the ball travel scale, wherein the ball travel scale comprises a visual representation for displaying a plurality of distances, wherein the range control lever is positionable at a plurality of positions relative to the ball travel scale, wherein the plurality of positions corresponds to the plurality of distances for propelling the ball.

9. The propellent-driven golf club of claim 8, wherein the range control lever is configured to float independently on a range control valve shaft to prevent loosening of the range control lever on the range control valve shaft due to shock waves generated during the firing of the cartridge, wherein the range control valve shaft is comprised in the range control mechanism.

10. The propellent-driven golf club of claim 1 further comprising a reducer thruster ring disposed around a periphery of the firing cylinder bore proximal to a club face of the propellent-driven golf club, wherein the reducer thruster ring comprises a plurality of orifices configured for reducing a flow rate of the gases before hitting a static atmospheric pressure, wherein the reducing the flow rate of the gases reduces a sound decibel level associated with the firing of the cartridge.

11. The propellent-driven golf club of claim 1, wherein the chamber comprises a coating of platinum, rhodium, and *caladium* on an internal surface of the chamber.

12. The propellent-driven golf club of claim 1, wherein the piston comprises a plurality of raised lands and a plurality of grooves disposed on an outer surface of the piston, wherein the piston slides on the plurality of raised lands and the plurality of grooves, wherein sliding of the piston corresponds to driving of the piston.

13. The propellent-driven golf club of claim 12 further comprising a hard anodized Teflon coating impregnated on the piston, wherein the hard anodized Teflon coating reduces friction between the piston and the firing cylinder bore for facilitating the sliding of the piston.

14. The propellent-driven golf club of claim 1 further comprising an anti-skid mechanism disposed on a bottom surface of the golf club head assembly, wherein the anti-skid mechanism comprises a cleat plate, wherein the cleat plate comprises a plurality of cleats configured to generate a frictional force between the propellent-driven golf club and an external ground surface, wherein the propellent-driven golf club rests on the external ground surface during the propelling of the ball, wherein the frictional force resists a recoil motion imparted to the propellent-driven golf club based on the firing of the cartridge.

15. A propellent-driven golf club to launch a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism; and a golf club head assembly attached to a bottom portion of the hollow shaft, wherein the golf club head assembly comprises:

a rotary magazine configured to receive at least one reloadable wafer, wherein the rotary magazine is rotatable about a hinge pivot, wherein the at least one reloadable wafer comprises a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to force the gas to meet from opposite directions;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve;

a piston movably disposed in the firing cylinder bore, wherein the gases drive the piston, wherein a free end of the piston is configured to strike the ball; and a rotary magazine housing configured to accommodate the rotary magazine, wherein the rotary magazine housing is rotatable about the hinge pivot, wherein the rotary magazine housing is configured for transitioning between an extended state and a retracted state, wherein the rotary magazine housing in the extended state facilitates reloading of the at least one reloadable wafer, wherein the rotary magazine housing in the retracted state facilitates orienting the cartridge in a firing position ready to be fired by the firing mechanism.

16. The propellent-driven golf club of claim 15, wherein the golf club head assembly comprises a urethane spring brake extending horizontally in a longitudinal slot comprised in the firing cylinder bore, wherein the piston stops against the urethane spring brake after launching the ball, wherein the urethane spring brake is configured for absorbing a kinetic energy of the piston for stopping the piston, wherein the urethane spring brake deforms based on the piston stopping against the urethane spring brake.

17. The propellent-driven golf club of claim 15, wherein the handle comprises a motorized handle mechanically coupled with the firing mechanism, wherein the motorized handle comprises:

at least one motor switch comprising a top switch and a lower switch, wherein each of the top switch and the lower switch is configured to be transitioned between a switch pressed state and a switch raised state;

an actuating motor configured for rotating a drive screw based on a state of the at least one switch, wherein the top switch in the switch pressed state causes clockwise rotation of the drive screw, wherein the lower switch in the switch pressed state causes counter-clockwise rotation of the drive screw;

a cocking actuator operationally coupled with the drive screw, wherein the cocking actuator is configured to be transitioned between an actuator top position and an actuator bottom position based on the rotating of the drive screw, wherein the cocking actuator traverses from the actuator top position to the actuator bottom position based on the counter-clockwise rotation of the drive screw, wherein the cocking actuator traverses from the actuator bottom position to the actuator top position based on the clockwise rotation of the drive screw; and a rechargeable power source electrically coupled with the actuating motor, wherein the rechargeable power source is configured for providing electrical power to the actuating motor, wherein a motorized firing pin spring comprised in the firing mechanism is compressed based on the cocking actuator reaching the actuator top position, wherein the firing mechanism is ready to fire the cartridge based on compressing of the motorized firing pin spring.

18. The propellent-driven golf club of claim 15, wherein the golf club head assembly further comprises:

a firing pin housing lever configured to be pressed forward for transitioning the firing pin housing lever to an activated state from a deactivated state based on a user pressing action performed by a user to facilitate reloading of the propellent-driven golf club, wherein the reloading of the propellent-driven golf club comprises positioning a second cartridge of the plurality of cartridges to a firing position after firing of the cartridge; and a firing pin housing cam rotor operationally coupled with the firing pin housing lever, wherein the firing pin housing cam rotor configured to be rotated based on a user rotating action, wherein the user rotating action positions the firing pin housing cam rotor on top of the second cartridge to be fired, wherein the transitioning of the firing pin housing lever to the activated state followed by the user rotating action positions the second cartridge to the firing position, wherein the firing mechanism is configured for firing the second cartridge in the firing position.

19. The propellent-driven golf club of claim 15, wherein the range control mechanism further comprises a range control lever and a ball travel scale, wherein the range control lever is disposed proximal to the ball travel scale, wherein the ball travel scale comprises a visual representation for displaying a plurality of distances, wherein the range control lever is positionable at a plurality of positions relative to the ball travel scale, wherein the plurality of positions corresponds to the plurality of distances for launching the ball.

20. A propellent-driven golf club to launch a ball without requiring a swinging action on the propellent-driven golf club, the propellent-driven golf club comprising:

a hollow shaft;

a handle attached to a top portion of the hollow shaft, wherein the handle comprises a triggering device configured for actuating a firing mechanism, wherein the handle comprises a motorized handle mechanically coupled with the firing mechanism, wherein the motorized handle comprises:

at least one motor switch comprising a top switch and a lower switch, wherein each of the top switch and the lower switch is configured to be transitioned between a switch pressed state and a switch raised state;

an actuating motor configured for rotating a drive screw based on a state of the at least one switch, wherein the top switch in the switch pressed state causes clockwise rotation of the drive screw, wherein the lower switch in the switch pressed state causes counter-clockwise rotation of the drive screw;

a cocking actuator operationally coupled with the drive screw, wherein the cocking actuator is configured to be transitioned between an actuator top position and an actuator bottom position based on the rotating of the drive screw, wherein the cocking actuator traverses from the actuator top position to the actuator bottom position based on the counter-clockwise rotation of the drive screw, wherein the cocking actuator traverses from the actuator bottom position to the actuator top position based on the clockwise rotation of the drive screw; and a rechargeable power source electrically coupled with the actuating motor, wherein the rechargeable power source is configured for providing electrical power to the actuating motor, wherein a motorized firing pin spring comprised in the firing mechanism is compressed based on the cocking actuator reaching the actuator top position, wherein the firing mechanism is ready to fire the cartridge based on compressing of the motorized firing pin spring; and a golf club head assembly attached to a bottom portion of the hollow shaft, wherein the golf club head assembly comprises:

a rotary magazine configured to receive at least one reloadable wafer, wherein the rotary magazine is rotatable about a hinge pivot, wherein the at least one reloadable wafer comprises a plurality of cartridges;

the firing mechanism operationally coupled to the triggering device, wherein the firing mechanism is configured for firing a cartridge of the plurality of cartridges upon the actuating, wherein firing the cartridge generates gases;

a firing cylinder port configured to mate with at least a portion of the cartridge;

a vortex generator comprising a chamber, wherein the chamber comprises an ingress port and an egress port, wherein the ingress port is fluidly coupled to the firing cylinder port in order to receive the gases, wherein an interior profile of the chamber is deflected to force the gas to meet from opposite directions;

a range control mechanism comprising a range control valve fluidly coupled to the egress port of the chamber, wherein the range control valve is configured to control a pressure of the gases at an outlet of the range control valve;

a firing cylinder bore fluidly coupled to the outlet of the range control valve;

a piston movably disposed in the firing cylinder bore, wherein the gases drive the piston, wherein a free end of the piston is configured to strike the ball; and a rotary magazine housing configured to accommodate the rotary magazine, wherein the rotary magazine housing is rotatable about the hinge pivot, wherein the rotary magazine housing is configured for transitioning between an extended state and a retracted state, wherein the rotary magazine housing in the extended state facilitates reloading of the at least one reloadable wafer, wherein the rotary magazine housing in the retracted state facilitates orienting the cartridge in a firing position ready to be fired by the firing mechanism.

* * * * *